US009509038B2

(12) United States Patent
Kagaya et al.

(10) Patent No.: US 9,509,038 B2
(45) Date of Patent: Nov. 29, 2016

(54) VEHICLE WINDOW GLASS AND ANTENNA

(71) Applicant: ASAHI GLASS COMPANY, LIMITED, Tokyo (JP)

(72) Inventors: Osamu Kagaya, Tokyo (JP); Koji Ikawa, Tokyo (JP); Kotaro Suenaga, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/830,337

(22) Filed: Aug. 19, 2015

(65) Prior Publication Data

US 2015/0357700 A1 Dec. 10, 2015

Related U.S. Application Data

(63) Continuation of application No. PCT/JP2014/054191, filed on Feb. 21, 2014.

(30) Foreign Application Priority Data

Feb. 21, 2013 (JP) ..... 2013-032428

(51) Int. Cl.
*H01Q 1/32* (2006.01)
*H01Q 1/12* (2006.01)
*H01Q 13/10* (2006.01)
(Continued)

(52) U.S. Cl.
CPC ..... *H01Q 1/1271* (2013.01); *H01Q 1/1285* (2013.01); *H01Q 1/27* (2013.01); *H01Q 9/285* (2013.01); *H01Q 13/10* (2013.01)

(58) Field of Classification Search
CPC ..... H01Q 1/27; H01Q 13/10; H01Q 9/285; H01Q 1/1271; H01Q 1/1285
USPC ..... 343/711, 713, 793, 846
See application file for complete search history.

(56) References Cited

U.S. PATENT DOCUMENTS 5,012,255 A 4/1991 Becker
5,355,144 A 10/1994 Walton et al.
5,760,744 A * 6/1998 Sauer ..... B32B 17/10036 343/700 MS (Continued)

FOREIGN PATENT DOCUMENTS

JP H06-045817 A 2/1994
JP H09-175166 A 7/1997

(Continued)

OTHER PUBLICATIONS

International Search Report corresponding to Application No. PCT/JP2014/054191, dated Apr. 22, 2014.

*Primary Examiner* — Dieu H Duong
(74) *Attorney, Agent, or Firm* — Foley & Lardner LLP

(57) ABSTRACT

Vehicle window glass include a glass plate, a dielectric, a conductive film, placed between the glass plate and the dielectric, and an antenna including a pair of electrodes. The conductive film, includes a pair of facing parts that faces the electrodes across the dielectric, a main slot, and a pair of sub slots. The main slot has, at one end, an open end open at an outer edge of the conductive film, and is formed between the facing parts. Each sub slot has, at one end, an open end open at the outer edge of the conductive film. One of the sub slots connects, at the other end, to the main slot so as to surround one of the facing parts. The other of the sub slots connects, at the other end, to the main slot so as to surround the other of the facing parts.

17 Claims, 19 Drawing Sheets

(51) Int. Cl.
*H01Q 1/27* (2006.01)
*H01Q 9/28* (2006.01)

(56) References Cited

U.S. PATENT DOCUMENTS

| | | | | |
|---|---|---|---|---|
| 5,898,407 | A | 4/1999 | Paulus et al. | |
| 6,320,276 | B1 | 11/2001 | Sauer | |
| 7,893,878 | B2 * | 2/2011 | Rofougaran | H01L 23/66 343/700 MS |
| 2009/0121957 | A1 | 5/2009 | Kaneko et al. | |
| 2010/0245197 | A1 | 9/2010 | Kerselaers | |
| 2012/0098715 | A1 | 4/2012 | Dai | |
| 2012/0098716 | A1 | 4/2012 | Dai | |
| 2012/0154229 | A1 | 6/2012 | Kagaya et al. | |
| 2013/0285861 | A1 | 10/2013 | Kagaya | |

FOREIGN PATENT DOCUMENTS

| | | | |
|---|---|---|---|
| JP | 2000-059123 | A | 2/2000 |
| JP | 2006-140735 | A | 6/2006 |
| WO | WO-2011/004877 | A1 | 1/2011 |
| WO | WO-2012/090883 | A1 | 7/2012 |

* cited by examiner

VEHICLE WINDOW GLASS AND ANTENNA

CROSS-REFERENCE TO RELATED APPLICATIONS

The present application is a continuation application filed under 35 U.S.C. 111 (a) claiming benefit under 35 U.S.C. 120 and 365 (c) of PCT International Application No. PCT/JP2014/054191, filed on Feb. 21, 2014 and designating the U.S., which claims priority to Japanese Patent Application No. 2013-032428, filed on Feb. 21, 2013. The entire contents of the foregoing applications are incorporated herein by reference.

BACKGROUND OF THE INVENTION

1. Field of the Invention

The present invention relates to vehicle window glass and antennas that include a conductive film in which a slot is formed.

2. Description of the Related Art

Vehicle window glass of laminated glass formed by inserting an intermediate film between two glass plates inside which a conductive film is formed in order to reflect heat is known. In the case where an antenna conductor for receiving radio waves is formed on such vehicle window glass on its vehicle interior side, radio waves arriving frost outside the vehicle are blocked by the conductive film, so that the reception characteristics required of the antenna conductor may not be sufficiently obtained.

Window glass that uses a conductive film to have an antenna function in order to eliminate such an adverse effect is known. (For example, see Patent Documents 1, 2, 3, 4 and 5.)

Patent Documents 1, 2 and 4 are directed to slot antennas that use a slot between a flange of a vehicle body to which a glass plate is fixed and a conductive film. In the case of slot antennas that use a slot between a flange or a vehicle body and a conductive film, the size of the slot is determined vehicle type by vehicle type, and in particular, it is difficult to cause resonance at a predetermined frequency to receive radio waves in high-frequency bands. Furthermore, in order to receive radio waves in high-frequency bands, the positional relationship between the flange and the conductive film should be accurately controlled. However, there are variations in individual glass plates, and the glass plate is fixed to the flange of the vehicle body with an adhesive agent. Therefore, errors are variably caused in the thickness of the adhesive agent, the position at which the glass plate is fixed to the flange, etc. Accordingly, there has been a problem in that it as difficult to form slots of the same size in mass production.

Furthermore, in the case where a slot is provided in the conductive film in addition to the slot between the flange of the vehicle body and the conductive film as in Paten Document 4, the slot reduces the effect of the conductive film if the slot is large, and there is another problem in that a large heat distribution is generated on the glass plate based on the presence or absence of the conductive film so as to reduce forming accuracy when heating and bending the glass plate.

In order to solve the above-described problems, the antenna disclosed in Patent Document 5 is configured so that a slot formed in a conductive film is positioned between a pair of electrodes when the pair of electrodes is projected onto the conductive film and that the pair of electrodes and the conductive film are capacitively coupled. According to such an antenna configuration, a change in an external environment (including window glass, a part of a vehicle body to which window glass is attached, such as a flange, and the size and shape of a conductive film) is leas likely to change antenna characteristics.

[Prior Art Documents]

[Patent Documents]

[Patent Document 1] Japanese Laid-Open Patent Application No. 6-45817

[Patent Document 2] Japanese Laid-Open Patent Application No. 9-175166

[Patent Document 3] Japanese Laid-Open Patent Application No. 2000-59123

[Patent Document 4] United States Patent No. 5012255

[Patent Document 5] International Publication Pamphlet No. WO 2011/004877

SUMMARY OF THE INVENTION

According to an aspect of one present invention, vehicle window glass includes a glass plate, a dielectric, a conductive film placed between the glass plate and the dielectric, and an antenna including a pair of electrodes placed to face the conductive film across the dielectric. The conductive film includes a pair of facing parts that faces the pair of electrodes across the dielectric, a main slot, and a pair of sub slots. The main slot has, at one end, an open end that is open at an outer edge of the conductive film, and is formed between the pair of facing parts. Each of the pair of sub slots has, at one end, an open end that is open at the outer edge of the conductive film. One of the sub slots connects, at the other end, to the main slot so as to surround one of the pair of facing parts, and the other or the sub slots connects, at the other end, to the main slot so as to surround the other of the pair of facing parts.

According to an aspect of the present invention, an antenna includes a dielectric, a conductive film, and a pair of electrodes placed to face the conductive includes a across the dielectric. The conductive film includes a pair of facing parts that faces the pair of electrodes across the dielectric, a main slot, and a pair of sub slots. The main slot has, at one end, an open end that is open an outer edge of the conductive film, and is formed between the pair of facing parts. Each of the pair of sub slots has, at one end, an open end that is open at the outer edge of the conductive film. One of the sub slots connects/at the other end, to the main, slot so as to surround one of the pair of facing parts, and the other of the sub slots connects, at the other end, to the main slot so as to surround the other of the pair of facing parts.

DETAILED DESCRIPTION OF THE PREFERRED EMBODIMENTS

Figure 1:
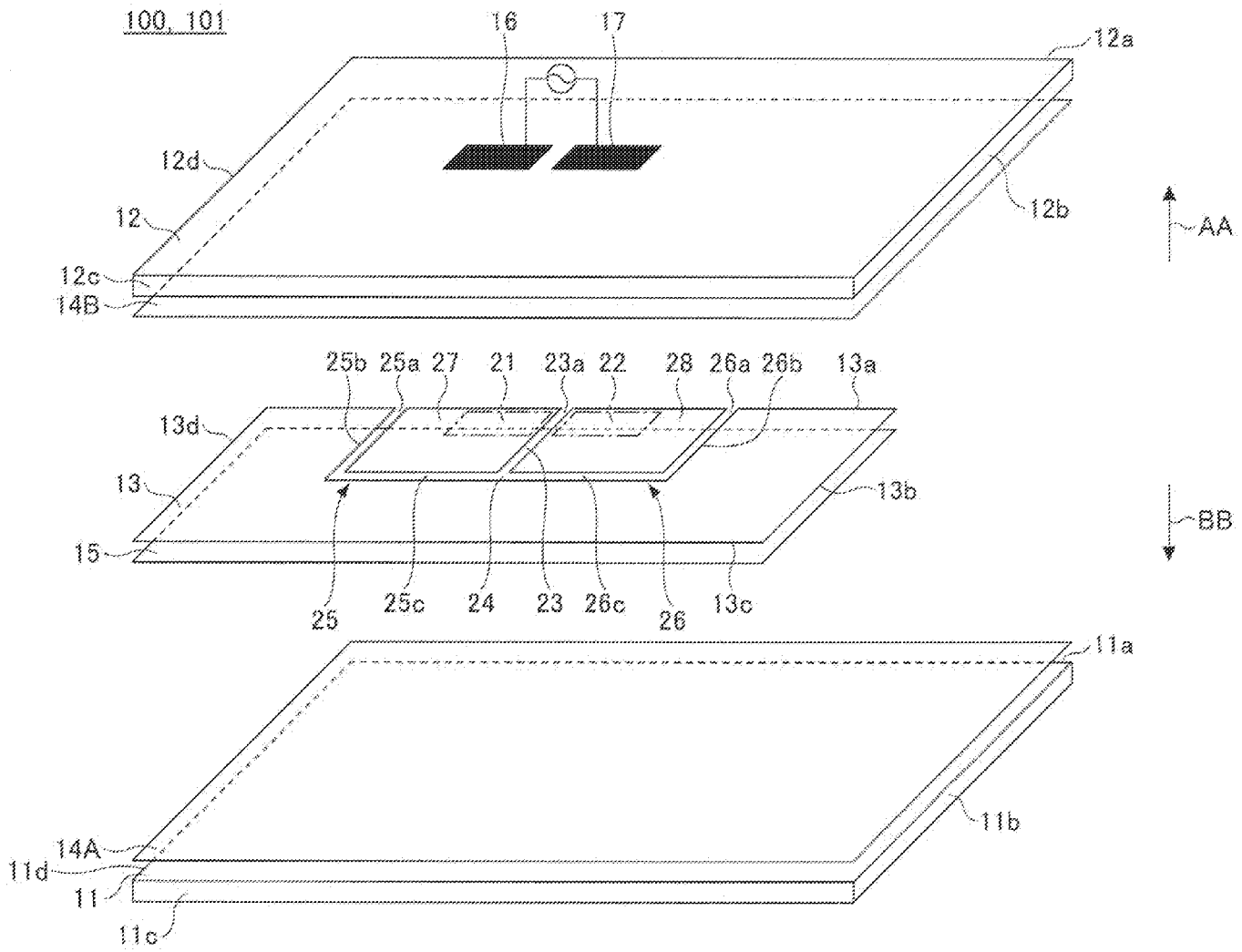
FIG. 1 is an exploded view of vehicle window glass and an antenna.

According to the antenna configuration where a slot is formed in the conductive film, it is difficult to easily change the size of the slot, so that it is difficult to tune the antenna in the actual external environment. Therefore, there is a demand for an antenna that is not only less susceptible to changes in conditions in the actual external environment but also less variable in antenna characteristics, particularly, the resonant frequency, when applied in the actual external environment, even when the antenna has been designed in a virtual development environment different from the actual external environment.

According to an aspect of the present invention, it is possible to provide an antenna that is less variable in antenna characteristics, particularly, the resonant frequency, with respect to changes in an external environment.

According to an aspect of the present invention, it is possible to provide vehicle window glass with an antenna that is less variable in antenna characteristics, particularly, the resonant frequency, with respect to changes in an external environment.

A description, will hereinafter be given of embodiment of the present invention with reference to the drawings. In the drawings used so describe the embodiments, directions refer to the directions in the figures unless otherwise indicated, and reference directions in the figures correspond to the directions indicated by symbols or reference numerals. In addition, directions that are parallel, perpendicular, or the like may tolerate an error to a certain extent that does not impair the effects of the present invention. Furthermore, examples of window glass to which the present invention may be applied include a windshield attached to the front of a vehicle, rear glass attached to the rear of a vehicle, side glass attached to the side of a vehicle, and roof glass attached to a ceiling portion of a vehicle.

FIG. 1 is an exploded view of vehicle window glass 100 and an antenna 101 according to an embodiment of the present invention. In FIG. 1, the direction toward the interior side of a vehicle is indicated by an arrow AA and the direction toward the exterior side of the vehicle is indicated by an arrow BB, for example.

The window glass 100 is laminated grass formed by bonding together a glass plate 11, which is a first glass plate placed on the vehicle exterior side, and a glass plate 12, which is a second, glass plate placed on the vehicle inferior side, via intermediate films 14A and 14B. FIG. 1 shows constituent elements of the window glass 100 separated in a direction of a normal to a surface of the glass plate 11 (or the glass plate 12). Furthermore, the window glass 100 includes a conductive film 13 and antenna 101.

The glass plates 11 and 12 are transparent plate-shaped dielectrics. One or both or the glass plates 11 and 12 soap be translucent. The conductive film 13 as a transparent or translucent conductive film. As illustrated in FIG. 1, the antenna 101 is a bipolar antenna that includes the glass plate 12 serve as a dielectric, the conductive film 13 in which slots are formed, and a pair of electrodes 16 and 17 placed to face the conductive of film 13 across the glass plate 12. The dielectric of the antenna 101 may include the intermediate films 14A and 14B and the glass plate 11.

The conductive film 13 includes a pair of facing parts 27 and 28, a main slot 23, and a pair of sub slots 25 and 26. The pair of facing parts 27 and 28 is a conductor portion of the conductive film 13 that faces the pair of electrodes 16 and 17 across the glass plate 12. One end of the main slot 23 is an open end 23*a* that is open at an outer edge 13*a* of the conductive film 13. The main slot 23 is an elongated area between the pair of facing parts 27 and 28 where the conductive film 13 is removed or no conductive film is formed. One end of the sub slot 25, which is one of the pair of sub slots 25 and 26, is an open end 25*a* that, is open at the outer edge 13*a* of the conductive film 13. The sub slot 25 is an area that connects to the main slot 23 at the other end of the sub slot 25 so as to surround the facing part 27 of the pair of facing parts 27 and 28, where the conductive film 13 is removed or no conductive film is formed. One end of the other sub slot 26 is an open end 26*a* that is open at the outer edge 13*a* of the conductive film 13. The sub slot 26 is an area that connects to the main slot 33 at the other end or the sub slot 26 so as to surround the facing part 28, which is the other of the pair of facing parts 27 and 28 different from the facing part surrounded by the sub slot 25, where the conductive film 13 is removed or no conductive film is formed.

The main slot 23 and the pair of sub slots 25 and 26 may be formed by removing the conductive film 13 by exposing the conductive film 13 to laser light, or may be formed by preventing a conductive film from being formed in slot areas from the beginning by masking or the like at the time of forming the conductive film 13. The below-described slots (such as ether main slots, other sub slots, additional slots, auxiliary sub slots, and an independent slot) also may be formed in the same manner.

In FIG. 1, the pair of sub slots 25 and 26 cross the main, slot 23 at an intersection 24 so as to surround the pair of facing parts 27 and 28, respectively. Crossing is not necessarily limited to crisscrossing, and may include T-shaped crossing and connections of slots in other crossing manners.

The pair of electrodes 16 and 17 is a feeding part placed to face the conductive film 13 across the glass plate 12 serving as a dielectric. The dielectric is held between the pair of electrodes 16 and 17 and the conductive film 13, which is a conductor. Therefore, the electrode 16 is capacitively coupled to a projection area 21, which is the area of projection of the electrode 16 onto the conductive film 13, via the glass plate 12, and the other electrode 17 is capacitively coupled to a projection area 22, which is the area of projection of the electrode 17 onto the conductive film 13, via the glass plate 12. The projection area 21 is a conductor portion included in the facing part 27, and the projection area 22 is a conductor portion included in the other facing part 28.

According to such a configuration, an electric current excited along the roam slot 23 flows on the conductive film 13 along the pair of sub slots 25 and 26. Therefore, feeding power to the pair of electrodes 16 and 17 that are capacitively coupled to the projection areas 21 and 22 of the pair of facing parts 27 and 28 makes it possible for this configuration to function as an antenna.

The pair of facing parts 27 and 28 is surrounded by the main slot 23, the pair of sub slots 25 and 26, and the outer edge 13*a* of the conductive film 13. Therefore, it is possible, to prevent diffusion of an electric current that flows along the main, slot 23 and the outer edge 13*a*. Thus, compared with the case where the pair of sub slots 25 and 26 is absent, it is possible to reduce she effect of so external environment such as the size of the conductive film 13 on the resonant frequency of the antenna 101, so that it is possible to easily tune the antenna 101.

For example, even when antenna characteristics are evaluated in a virtual development environment different from the actual, external environment in which the antenna is mounted, it is possible to obtain substantially the same results as in the case of performing evaluation in the actual external environment. That is, even when an antenna tuned in a virtual development environment is mounted in an actual vehicle, antenna characteristics are unlikely to vary. Therefore, it is easy to predict antenna characteristics at the development stage, thus making it easy to advance the development of antennas.

Next, a description is given in more detail of embodiments of the present invention. According to the window glass 100 illustrated in FIG. 1, the glass plate 11 and the glass plate 12 are of the same sine. Peripheral, edges (11*a* through 11*d*) of the glass plate 11 and peripheral edges (12*a* through 12*d*) of the glass plate 12 are identical in shape when viewed in a direction in which the glass plate 12, the conductive film 13, and the glass plate 11 are stacked (hereinafter referred to as "stacking direction").

The conductive film 13 is, for example, a conductive heat reflecting film capable of reflecting incoming heat arriving from the outside. Alternatively, the conductive film 13 may be, for example, a conductive film through which an electric current flows to suppress fogging of the window glass 100. The conductive film 13 is, for example, a conductive film formed on a surface of a resin film 15 such as polyethylene terephthalate in a film shape. Alternatively, the conductive film 13 may be deposited (formed in a film) on a surface of the first glass plate 11 or a surface of the second glass plate 12 by sputtering or the like using a conductive material such as silver.

Figure 2:
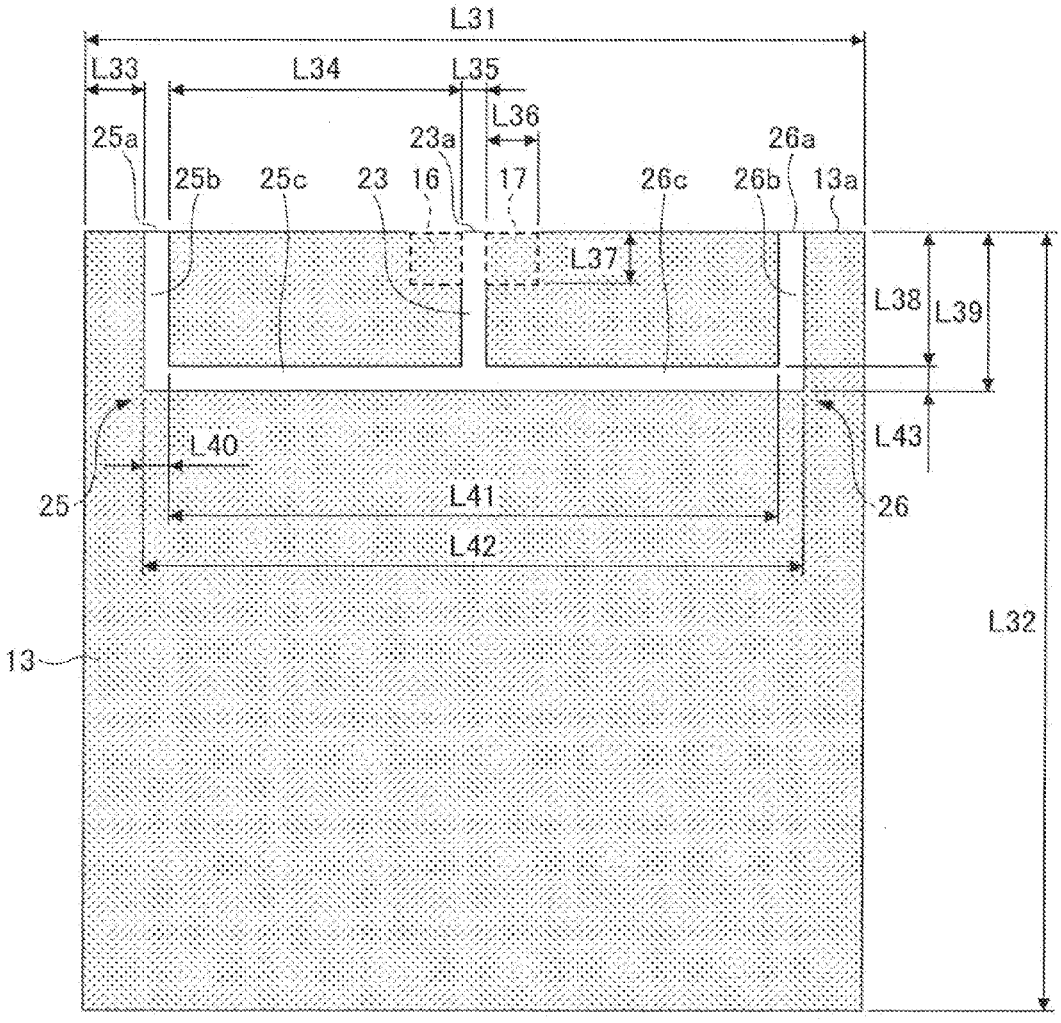
FIG. 2 is a plan view of a conductive film in which slots are formed.

FIG. 2 is a plan view of the conductive film 13 in which a slot is formed. In the conductive film 13, the main slot 23 is formed to have the open end 23*a* at the outer edge 13*a* of the conductive film 13. Furthermore, in the conductive film 13, the sub slot 25 is formed to have the open end 25*a* at the outer edge 13*a*, which is the same side on which the main slot 23 has the open end 23*a*, and the sub slot 26 is formed to have the open end 26*a* at the outer edge 13*a,* which is the same side on which the main slot 23 has the open end 23*a*. The open ends of the main slot 23 and the pair of sub slots 25 and 26 are on the same side of the conductive film 13. As a result, compared with the case where the open ends are on different sides of the conductive film 13, the resonant frequency of the antenna 101 is more unlikely to vary relative to a design value even in a virtual development environment different from the actual external environment.

Figure 3:
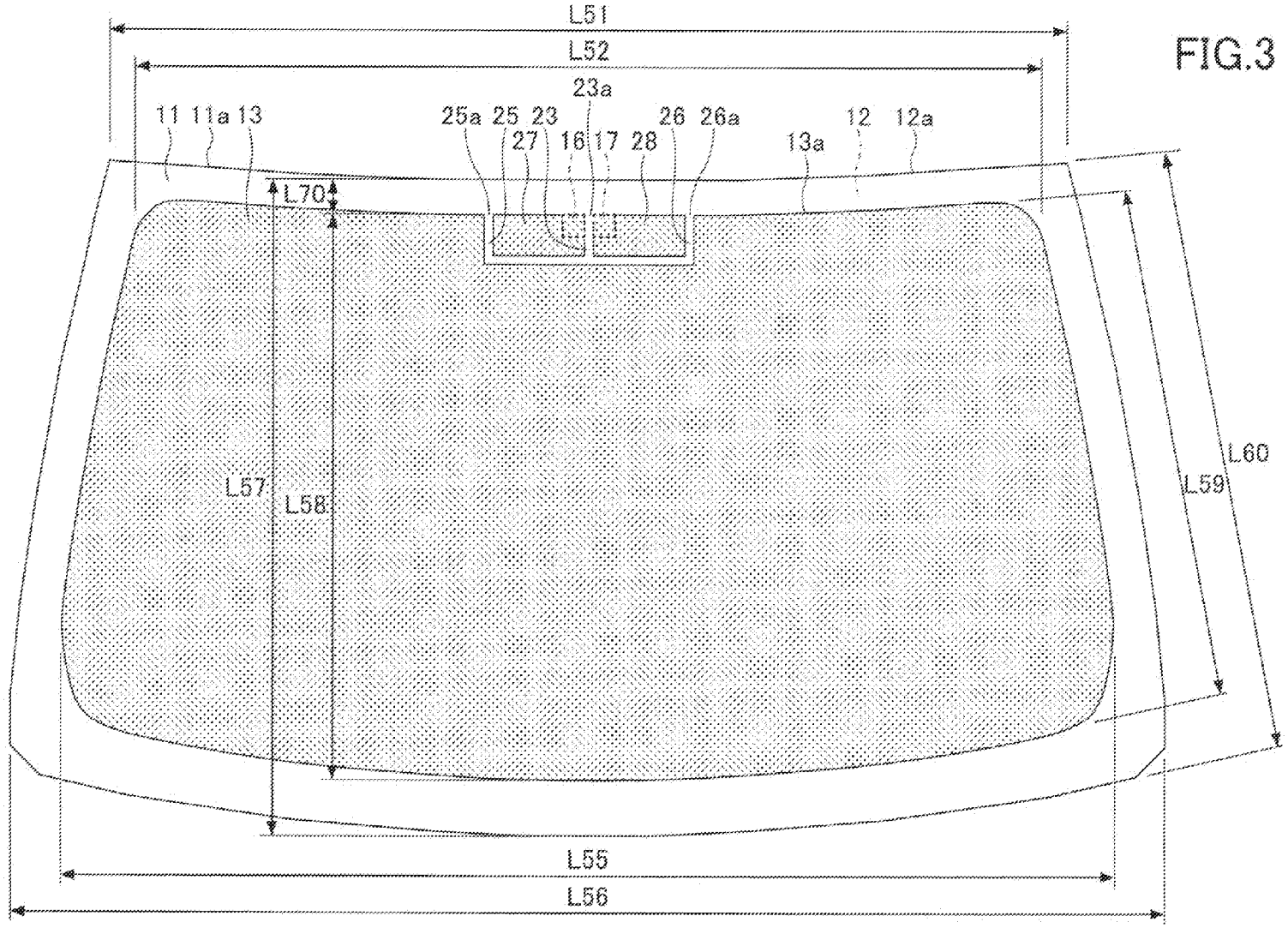
FIG. 3 is a plan view of vehicle window glass provided with the conductive film in which slots are formed.

FIG. 3 is a plan view of veicle window glass in which the main slot 23 of FIG. 2 is provided. The conductive film 13 is formed so that an outer edge of the conductive film 13 is located at a position set back inward from an outer edge of the vehicle window glass in accordance with the shape of the vehicle window glass. The conductive film 13 may be similar in shape to the masking film may be formed in a region between the outer edge of the vehicle window glass and the outer edge of the conductive film 13. The vehicle window glass normally has a trapezoidal shape, and the conductive film 13 may also have a similar trapezoidal shape. However, the shape of the conductive film 13 is not limited to a particular shape, and the conductive film 13 may have a polygonal shape such as a triangular shape, a rectangular shape, or the like. In addition, corner parts of the conductive film 13 may be curved. In FIG. 3, the open end 23*a* of the main slot 23 and the open ends 25*a* and 26*a* of the sub slots 25 and 26 are provided at the outer edge 13*a* of the upper side of the conductive film 13. The main slot 23, which is formed at the outer edge 13*a* of the upper side at the horizontal center of the vehicle window glass in FIG. 3, may be formed anywhere on the upper side or be formed on the left side, the right side or the lower side.

Figure 4:
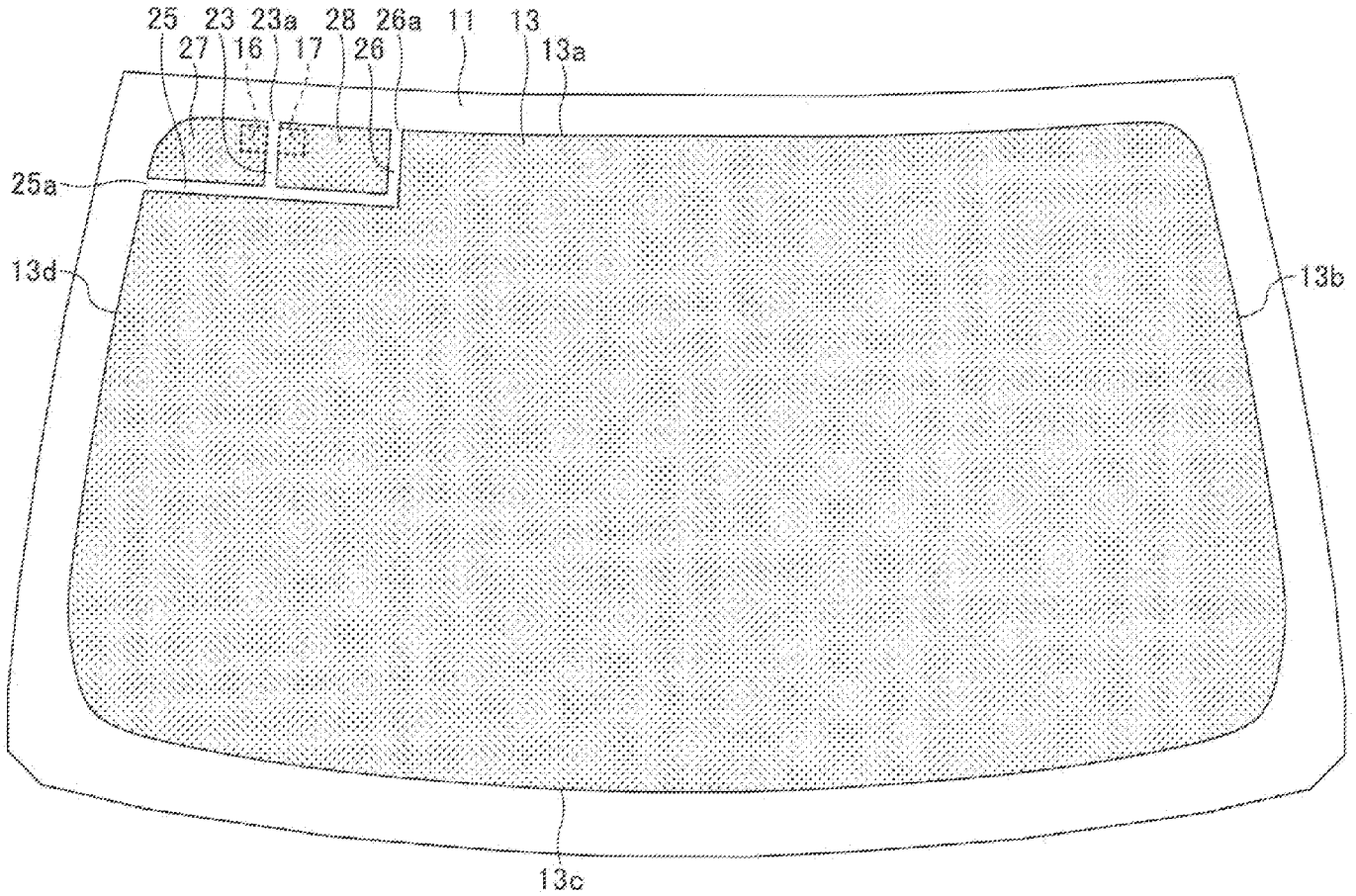
FIG. 4 is a plan view of vehicle window glass provided with the conductive film. In which slots are formed.

The outer edge of the conductive film 13 at which the open ends of the main slot 23 and the pair or sub slots 25 and 26 are formed does not necessarily have to be the same side, and may be sides different from each other. FIG. 4 is a plan view of window glass in which the conductive film 13 in which another example of the main slot 23 is formed is provided. For example, as illustrated in FIG. 4, the open end 23*a* of the main slot 23 and the open end 26*a* of the sub slot 26 may be provided at the outer edge 13*a* of the sub slot 26 may be provided open end 25*a* of the sub slot 25 may be provided at an outer edge 13*d* of the conductive film 13. the resonant frequency of the antenna is less likely to vary relative to a design value in a virtual development environment different from the actual external environment in the configuration where each of the open ends 23*a*, 25*a* and 26*a* is provided at the outer edge 13*a* than in the configuration of FIG. 4 where the open end 25*a* alone is provided at the outer edge 13*d*. The resonant frequency of the antenna is unlikely to vary relative to a design value in a virtual development environment different from the actual external environment in each of the configuration where the open ends 23*a*, 25*a* and 26*a* are positioned at the center of the outer edge 13*a* and the configuration where the open ends 23*a*, 25*a* and 26*a* are positioned closer to the outer edge 13*d* or an outer edge 13*b* relative to the center.

Furthermore, the open ends of the main slot 23 and the pair of sub slots 25 and 26, which are preferably provided at the outer edge 13*a,* which is on the roof side of a vehicle when, the conductive film 13 is provided in the vehicle, in light of improvement in antenna gain, may alternatively be provided at outer edges that are not on the roof side of the vehicle (such as the outer edges 13*b* and 13*d* on the pillar side of the vehicle and an outer edge 13*c* on the chassis side of the vehicle). Even when each open end is provided at an outer edge that is not on the roof side of the vehicle, the resonant frequency of the antenna is unlikely to vary relative to a design value in a virtual development environment different from the actual external environment.

In FIG. 1, the main slot 23 is formed in an in-plane direction of the conductive film 13 from the outer edge 13*a* of the conductive film 13. The outer edge 13*a* is one side of the perimeter of the conductive film 13. The main slot 23 is formed by rectilinearly removing the conductive film 13 from the open end 23*a* to an end inside the conductive film 13. The sub slot 25 is formed by removing the conductive film 13 in an L shape from the open end 25*a* to an end inside the conductive film 13. The sub slot 26 is formed by removing the conductive film 13 in an L shape from the open end 26*a* to an end inside the conductive film 13. The end of the main slot 23, the end of the sub slot 25, and the end of the sub slot 26 cross at the intersection 24 in a T shape.

The sub slot 25 includes a slot portion 25*b* formed to be perpendicular to the outer edge 13*a* and a parallel slot portion 25*c* formed to be parallel to the outer edge 13*a*. One end of the slot portion 25*b* is open at the open end 25*a*, and the other end connects to one end of the parallel slot portion 25*c*. The other end of the parallel slot portion 25*c* connects to the end of the main slot 23 and the end of the sub slot 26.

The sub slot 26 includes a slot portion 26*b* formed to be perpendicular to the outer edge 13*a* and a parallel slot portion 26*c* formed to be parallel to the outer edge 13*a*. One end of the slot portion 26*b* is open at the open end 26*a*, and the other end connects to one end of the parallel slot portion 26*c*. The other end of the parallel slot portion 26*c* connects to the end of the main slot 23 and the end of the sub slot 25.

The pair of electrodes 16 and 17 is disposed on the opposite side of the glass plate 12 from the conductive layer 13. The electrode 16 is exposed and disposed on a surface of the glass plate is facing the inside of the vehicle such that the projection area 21 formed by projecting the electrode 16 in the stacking direction is positioned inside of the outer edge 13*a* of the conductive film 13. The surface of the glass plate 12 facing the inside of the vehicle is opposite from a surface of the glass plate 12 facing the conductive film 13. The electrode 17 is disposed in a similar manner.

The electrodes 16 and 17 are arranged in a direction that is orthogonal to the longitudinal direction of the main slot 23 and is parallel to a surface of the glass plate 12. The positional relationship between the electrode 16 and the electrode 17 is not limited to this example. As another example, the pair of electrodes 16 and 17 may be arranged such that the main slot 23 is offset from a middle area between the electrodes 16 and 17 when seen from the stacking direction. A part or the whole of the pair of electrodes 16 and 17 may overlap the main slot 23 when seen from the stacking direction. Also, the pair or electrodes 16 and 17 may be disposed at positions that are away from the outer edge 13*a* in an in-plane direction of the conductive film 13 along the main slot 23.

The configurations (shape, size, etc. of the main slot 23, the pair of sub slots 25 and 26, and the electrodes 16 and 17 may be determined freely as long as the antenna 101 can achieve an antenna gain that is necessary to receive a radio wave in a frequency band that the antenna 101 is intended to receive. For example, when the antenna 101 is intended to receive a digital terrestrial television broadcasting frequency band of 470 to 710 MHz, the main slot 23, the pair of sub slots 25 and 26, and the pair of electrodes 16 and 17 are formed to suit the reception of a radio wave in the digital terrestrial television broadcasting frequency band of 470 to 710 MHz.

The main slot 33, the pair of sub slots 25 and 26, and the pair of electrodes 16 and 17 may be placed in any appropriate positions on the window glass that are suitable to receive a radio cave in a frequency band that the antenna 101 is intended to receive. For example, an antenna of the present embodiment is disposed near a vehicle flange to which the window glass is attached. Disposing the antenna near a roof-side edge of a vehicle flange is preferable to make it easier to achieve impedance matching and to improve radiation efficiency. Also, the antenna may be disposed at a position, that is shifted from the center in the vehicle width direction to the right or the left, i.e., at a position closer to a pillar-side edge of the vehicle flange. Further, the antenna may be disposed near a chassis-side edge of the vehicle flange.

The longitudinal direction of the main slot 23 catches, for example, a direction that is orthogonal to an edge of the vehicle flange. However, the longitudinal direction of the main slot 23 is not necessarily orthogonal to an edge of the vehicle flange (or the outer edge 13*a* of the conductive film 13), and an angle between the longitudinal direction of the main slot 23 and the edge of the vehicle flange may be greater than or equal to 5 degrees and less than 90 degrees.

The angle of mounting the window glass on a vehicle is preferably between 15 and 90 degrees and more preferably between 30 and 90 degrees with respect to a horizontal plane (ground surface) to make it easier to achieve impedance matching and to improve radiation efficiency.

For example, when the electrode 17 is need for a signal line and the electrode 10 is used for a ground line, the electrode 17 is conductively connected to the signal line connected to a signal processing apparatus (e.g., an amplifier) provided an a vehicle body, and the electrode 16 is conductively connected to the ground line connected to a ground of the vehicle body. The ground of the vehicle body is, for example, body grounding or a ground or the signal processing apparatus to which the signal line connected to the electrode 13 is connected. Alternatively, the electrode 17 may be used for the ground line, and the electrode 16 may be used for tire signal line.

The areas of the facing part 23 and the facing part 28, which are equal in the case of FIG. 1, may be different. When the area of the facing part 27 is larger than the area of the facing part 28, it is preferable that the electrode 17 be en electrode on the signal line side and the electrode 16 be an electrode on the ground. line side. Because power is fed through an unbalanced transmission system, it is preferable to make the area of a facing part on the ground side larger than the area of a facing part on the signal line side.

A received radio wave that is represented by an electric current generated alone the main slot 23 and the pair of sub slots 25 and 26 is transmitted via a conductive part electrically connected to the pair of electrodes 16 and 17 to the signal processing apparatus provided in the vehicle. As the conductive part, a feeder line such as an AV line or a coaxial cable is preferably used.

When a coaxial cable is used as a feeder line for supplying electricity via the pair of electrodes 16 and 17 to this antenna, for example, the inner conductor of the coaxial cable may be electrically connected to the electrode 17, and the outer conductor of the coaxial, cable may be connected to the electrode 16. Also, connectors for electrically connecting the pair of electrodes 16 and 17 to conductive parts such as wires connected to the signal processing apparatus may be attached to the pair of electrodes 16 and 17. Such connectors make it easier to connect the inner conductor of the coaxial cable to the electrode 17 and connect the outer conductor of the coaxial cable to the electrode 16. Further, protruding conductive parts may be attached to the pair of electrodes 16 and 17. In this case, for example, the protruding conductive parts are brought into contact with or fit into feeding parts provided in a vehicle flange to which the vehicle window glass 100 is attached.

The shape of the pair of electrodes 16 and 17 and the interval between the electrodes may be determined in view of the shape of the mounting surfaces of the above-described conductive parts or connector and the interval between their mounting surfaces. For example, in terms of implementation, the electrodes 16 and 17 preferably have a quadrangular shape such as a square shape, an approximately-square shape, a rectangular shape, or an approximately-rectangular shape. Still, however, the electrodes 16 and 17 may have a circular shape, an approximately-circular shape, an oval shape, or an approximately-oval shape.

The pair of electrodes 16 and 17 is formed, for example, by printing a pattern, on the inner surface of the glees plate 12 with a paste such as a silver paste including a conductive metal, and baking the printed pattern. However, the pair of electrodes 16 and 17 may also be formed by any other method. For example, the pair of electrodes 16 and 17 may be formed by bonding strip-like or foil-like parts comprised of a conductive material such as copper to the inner surface of the glass plate 12 using, for example, an adhesive.

Also, to make the pair of electrodes 16 and 17 invisible from the outside of the vehicle, a masking film may be formed on a surface of the glass plate 11 such that the masking film is disposed between the electrodes 16 and 17 and the glass plate 11. The masking film may be implemented by, for example, ceramic, which is a burned substance, such as a black ceramic film. In this case, the pair of electrodes 16 and 17 and a part of the antenna 1 on the masking film are masked by the masking film and become invisible from the outer side of the window glass. Thus, this configuration improves the design of the window glass.

The intermediate films 14A and 14B are placed between the first glass plate 11 and the second glass plate 12. The first glass plate 11 and the second glass plate 12 are joined by the intermediate films 14A and 14B. The intermediate films 14A and 14B are of, for example, thermoplastic polyvinyl butyral. As the relative permittivity $\epsilon r$ of the intermediate films 14A and 14B, the relative permittivity of a common intermediate film of laminated glass, which is 2.8 or more and 3.0 or less, may be applied.

FIGS. 5 through 9 illustrate variations of the form of stacking of window glass according to an embodiment of the present invention. In FIGS. 5 through 9, the conductive film 13 is placed between the glass plate 11 and a dielectric (the glass plate 12 or a dielectric substrate 32). The pair of electrodes 16 and 17 is placed so that a part or the whole of the pair of electrodes 16 and 17 overlaps the conductive film 13 when viewed in the stacking direction.

Figure 5:
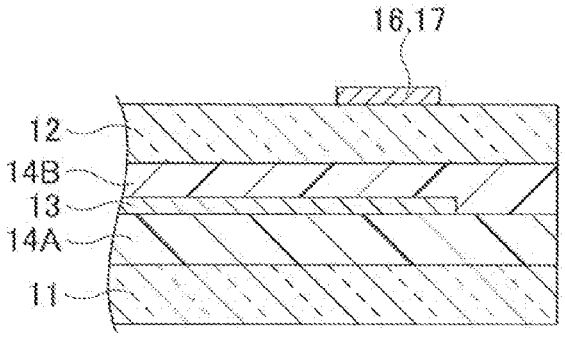
FIG. 5 is a cross-sectional view of vehicle window glass.
Figure 6:
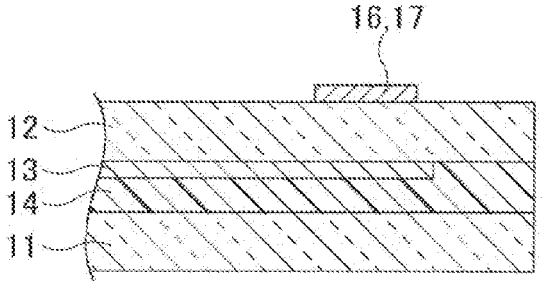
FIG. 6 is a cross-sectional view of vehicle window glass.
Figure 7:
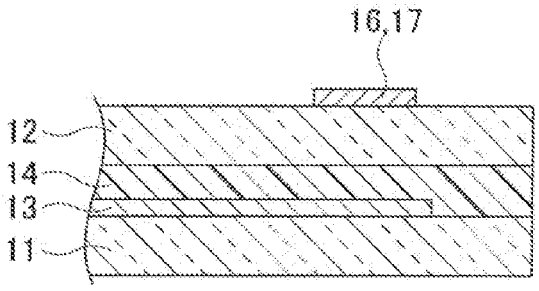

In the case of FIGS. 3 through 7, the conductive film 13 and an intermediate film 14 (or the intermediate film 14A and 14B) are placed between the glass plate 11 and the glass plate 12. FIG. 5 illustrates a configuration where the conductive film 13 is held between the intermediate film 14A that is in contact with a facing surface of the glass plate 11 that faces toward the glass plate 12 and the intermediate film 14B that is in contact with a facing surface of the glass plate 12 that faces toward the glass plate 11. The conductive film 13 may have a configuration where the conductive film 13 is vapor-deposited on and coats a predetermined resin film of polyethylene terephthalate or the like. FIG. 6 illustrates a configuration where the glass plate 12 is coated with the conductive film 13 by vapor-depositing the conductive film 13 on the facing surface of the glass plate 12 that faces toward the glass plate 11. FIG. 7 illustrates a configuration where the glass plate 11 is coated with the conductive film 13 by vapor-depositing the conductive film 13 on the facing surface of the glass plate 11 that faces toward the glass plate 12.

Figure 8:
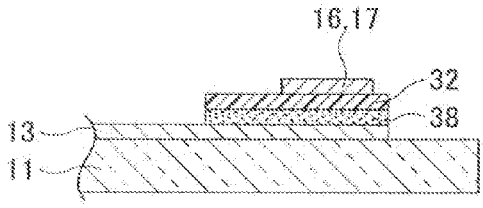
FIG. 8 is a cross-sectional view of vehicle window glass.
Figure 9:
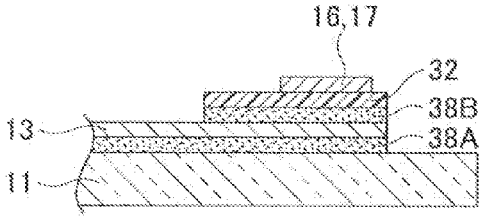
FIG. 9 is a cross-sectional view of vehicle window glass.
Figure 10:
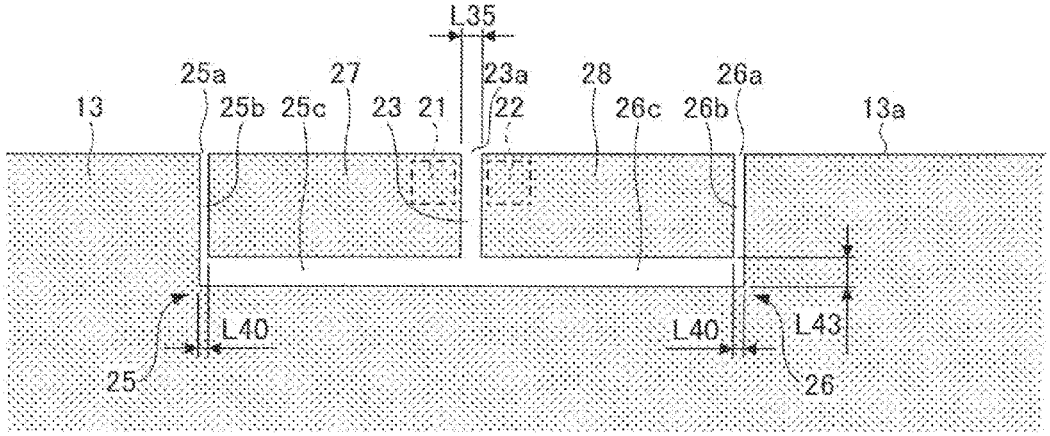
FIG. 10 is a plan view of the conductive film in which slots are formed.

Furthermore, as illustrated in FIGS. 8 and 9, vehicle window, glass according to embodiments of the present invention does not have to be laminated glass. In this case, the dielectric does not have to be equal in slave to the glass plate 11, and may be a dielectric substrate or the like of seen site as to allow formation of the pair of electrodes 16 and 17. In the case of FIGS. 3 and 9, the conductive film 13 is placed between the glass plate 11 and a dielectric substrate 32. FIG. 8 illustrates a configuration where the glass plate 11 is coated with the conductive film 13 by vapor-depositing the conductive film 13 on a facing surface of the glass plate 11 that faces toward the dielectric substrate 32. The conductive film 13 and the dielectric substrate 32. The bonded by an adhesive layer 38. FIG. 9 illustrates a configuration where the conductive film 13 is bonded to the facing surface of the glass plate 11 that faces toward the dielectric substrate 32 by an adhesive layer 38A. The conductive film 13 and the dielectric substrate 32 are bonded by an adhesive layer 38B. The dielectric substrate 32 is a resin substrate, on which the pair of electrodes 16 and 17 is provided. The dielectric substrate 32 may be a resin printed board (for example, a glass epoxy substrate formed by attaching copper foil to FR4) on which the pair of electrodes 16 and 17 is printed.

FIGS. 10 through 17 illustrate variations of the form of a slot of an antenna according to an embodiment of the present invention.

The antenna gain of the antenna of this embodiment increases by causing the slot width of the main slot 23 in a direction perpendicular to the longitudinal direction of the main slot 23 to be greater than the slot width of part of the pair of sub slots 25 and 26. For example, in FIG. 10, the antenna gain of the antenna of this embodiment increases by causing a slot width L35 of the main slot 23 to be greater than a slot width L40 of the slot portion 25*b* or the slot portion 26*b*. Furthermore, causing the slot width of the parallel slot portions 25*c* and 26*c* formed parallel to the outer edge 13*a* to be greater than the slot width of other portions of the pair of sub slots 25 and 26 also increases the antenna gain of the antenna of this embodiment. For example, in FIG. 10, the antenna gain of the antenna of this embodiment increases by causing a slot width L43 of the parallel slot portions 25*c* and 26*c* to be greater than the slot width L40 of the slot portion 25*b* or the slot portion 26*b*. *Furthermore, by causing the slot width L*35 of the main slot 23 and the slot width L43 of the parallel slot portions 26*c* and 26*c* to be predetermined widths with which it is possible to obtain sufficient antenna gain, it is possible to reduce the slot width or other portions. Reduction in the slot width improves productivity and is thus preferable.

Figure 11:
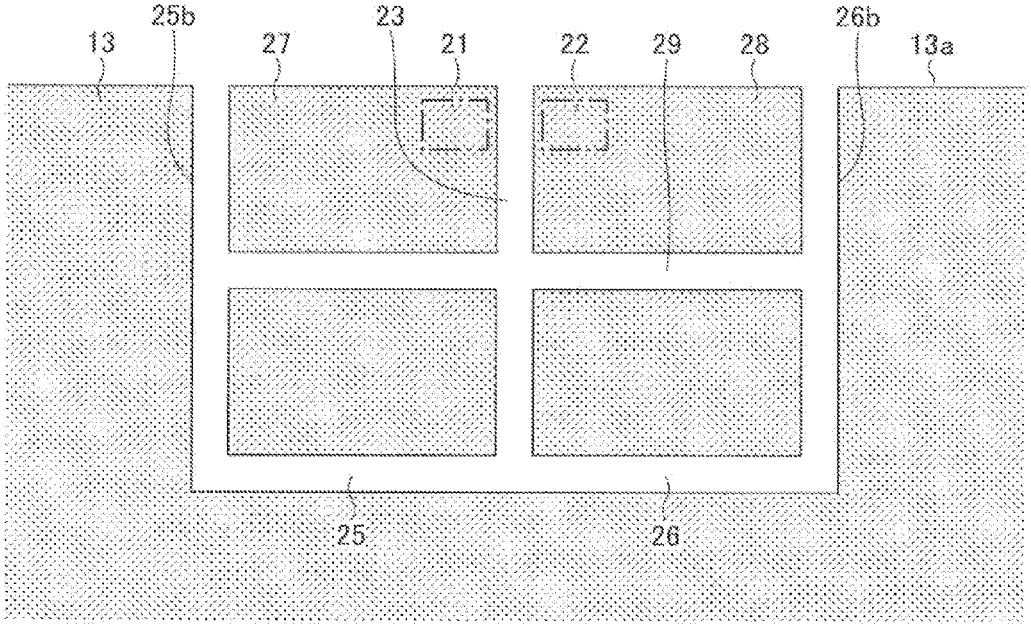
FIG. 11 is a plan view of the conductive film in which slots are formed.

In the case of FIG. 11, the conductive film 13 includes an additional slot 29 formed in the pair of facing parts 27 and 28 surrounded by the pair of sub slots 25 and 26. The additional slot 29 connects to the slot portion 25*b* of the sub slot 25 and the slot portion 26*b* of the sub slot 26 in a T-shaped manner at its ends, and crosses the center of the main slot 23 in a crisscross manner at its center. The additional slot 23 divides the pair of facing parts 27 and 28 into four regions. The additional slot 29 is an area that has the conductive film 13 linearly removed so as to be parallel to the outer edge 13*a*. The number of additional slots 29 may be one or more.

Figure 12:
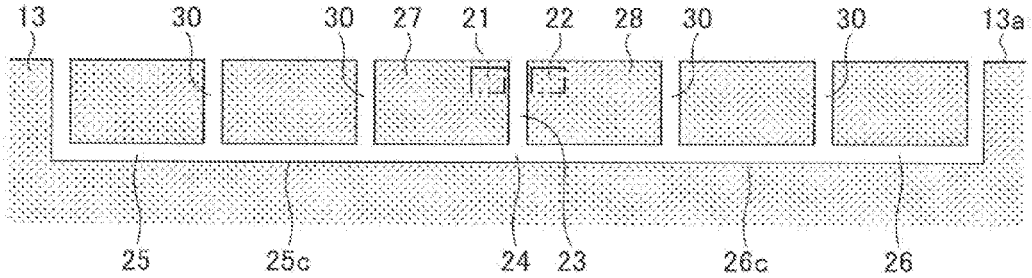
FIG. 12 is a plan view of the conductive film in which slots are formed.

In the case of FIG. 12, the conductive film 13 includes additional slots 30 formed in the pair of facing parts 27 and 28 surrounded by the pair of sub slots 25 and 26. The additional slots 30 connect to the parallel slot portion 25*c* of the sub slot 25 and the parallel slot portion 26*c* of the sub slot 26 in a T-shaped manner at their respective one ends, and are open at the outer edge 13*a* at their respective other ends. The pair of sub slots 25 and 26 includes the parallel slot portions 25*c* and 26*c* formed to be parallel to the outer edge 13*a* of the conductive film 13. In the case of FIG. 12, the additional slots 30 are areas that have the conductive film 13 linearly removed at right angles to the outer edge 13*a* so as to connect to the parallel slot portion 25*c* or 26*c*. In FIG. 12, the four additional slots 30 are formed so as to divide the pair of facing parts 27 and 28 into six regions. The number of additional slots 30 may be one or more.

Figure 13:
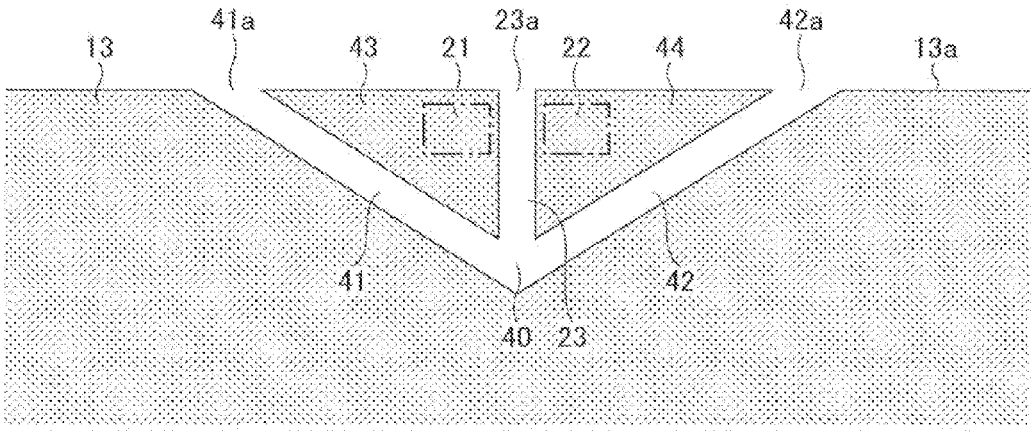
FIG. 13 is a plan view of the conductive film in which slots are formed.

In the case of FIG. 13, the conductive film 13 includes a pair of facing parts 43 and 44, the main slot 23, and a pair or sub slots 41 and 42. The pair of facing parts 43 and 44 are triangular conductor portions of the conductive film 13 that face the pair of electrodes 16 and 17 across a dielectric. The main slot 23 is an area that has the conductive film 13 linearly removed so as to have the open end 23*a*, which is open at the outer edge 13*a* of the conductive film 13, at one end of the main slot 23 and be positioned between, the pair of facing parts 43 and 44. The sub slot 41 is an area that has the conductive film 13 linearly removed so as to have an open end 41*a*, which is open at the outer edge 13*a* of the conductive film 13, at one end of the sub slot 41 and surround the facing part 43. The sub slot 42 is an area, that has the conductive film 13 linearly removed so as to have an open end 42*a*, which is open at the outer edge 13*a* of the conductive film 13, at one end of the sub slot 42 and surround the facing part 44. The pair of sub slots 41 and 42 extends at an angle to the outer edge 13*a* of the conductive film 13 so as to surround the pair of facing parts 43 and 44 to connect to an intersection 40 with the main slot 23 so that each of the pair of facing parts 43 and 44 has a triangular shape. The projection area 21 is a conductor portion included in the facing part 43 and the projection area 22 is a conductor portion included in the facing part 44*b*.

Figure 14:
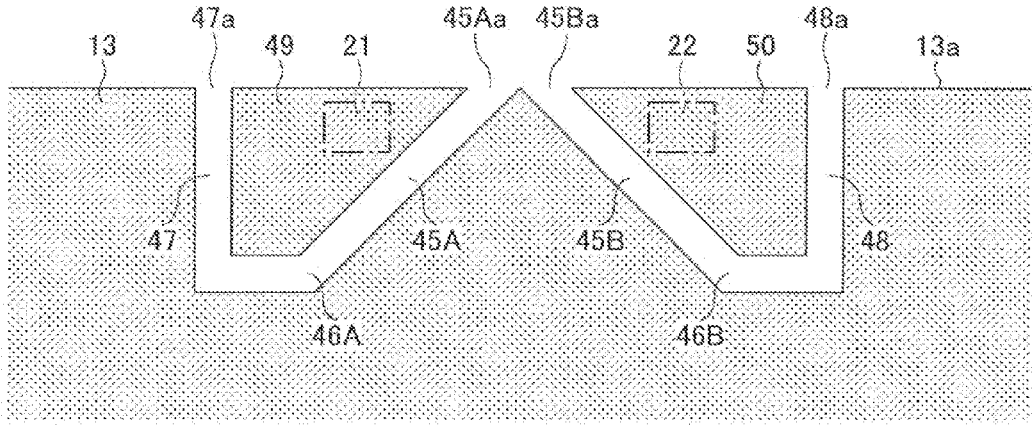
FIG. 14 is a plan view of the conductive film in which slots are formed.

In the case of FIG. 14, the conductive film 13 includes a pair of facing parts 49 and 50, a pair of main slots 45A and 45B, and a pair of sub slots 47 and 48. The pair of facing parts 49 and 50 are quadrangular conductor portions of the conductive film 13 that face the pair of electrodes 16 and 17 across a dielectric. The main slot 45A is an area that has the conductive film 13 linearly removed so as to have an open end 45Aa, which is open at the outer edge 13*a* of the conductive film 13, at one end of the main slot 45A and extend at an angle to the outer edge 13*a* to be positioned between the facing part 43 and the facing part 50. The main slot 45B is an area that has the conductive film 13 linearly removed so as to have an open end 45Ba, which is open at the outer edge 13*a* of the conductive film 13, at one end of the main slot 45B and extend at an angle to the outer edge 13*a* to be positioned between the facing part 49 and the facing part 50. The main slot may be formed of multiple slots as long as the slots are thus forced between a pair of facing parts. The sub slot 47 is an area that has the conductive film 13 linearly removed so as to have an. open end 47*a*, which is open at the outer edge 13*a* of the conductive film 13, at one end of the sub slot 45 and surround the facing part 49 to connect to the main slot 45A at an intersection 46A. The sub slot 18 is an area that has the conductive film 13 linearly removed so as to have an open end 48*a*, which is open at the enter edge 13*a* of the conductive film 13, at one end of the sub slot 43 and surround the facing part 30 to connect to the main slot 45B at an. intersection 46B. The projection area 21 is a conductor portion included in the facing part 49 and the projection area 22 is a conductor portion included in the facing part 50.

Figure 15:
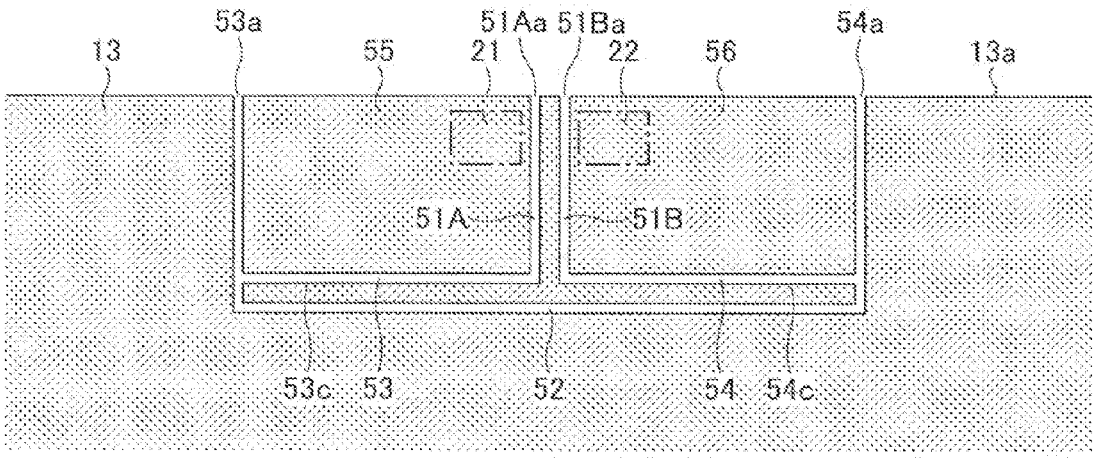
FIG. 15 is a plan, view of the conductive film in which slots are derived.

In the case of FIG. 15, the conductive film 13 includes a pair of facing parts 55 and 56, a pair of main slots 51A and 51B, a pair of sub slots 53 and 54, and an auxiliary sub slot 52. Furthermore, these slots are formed to be narrower in slob width than in the case of FIG. 1 by laser irradiation or the like. The pair of facing parts 35 and 56 are quadrangular conductor portions of the conductive film 13 that face the pair of electrodes 16 and 17 across a dielectric. The main slot 51A is an area that has the conductive film 13 linearly removed so as to have an open end 51A, which is open at the outer edge 13*a* of the conductive film 13, at one end of the main slot 51A and be positioned between the pair of racing parts 55 and 56. The main slot 51B is an area that has the conductive film 13 linearly removed so as to have an open end 51Ba, which is open at the outer edge 13*a* of the conductive film 13, at one end of the main slot 51B and be positioned between the pair of facing parts 55 and 56. The pair of main slots 51A and 51B forms a multiple slot composed of a number of slots that run in parallel at right angles to the outer edge 13*a*. In the case of FIG. 15, two slot, portions are arranged in parallel.

The sub slot 53 is an area that has the conductive the 13 linearly removed so as to have an open end 53*a*, which is open at the outer edge 13*a* of the conductive film 13, at one end of the sub slot 53 and surround the facing part 55 to connect to the main slot 51A. The sub slot 54 is an area that has the conductive film 13 linearly removed so as to have an open end 54*a*, which is open at the outer edge 13*a* of the conductive film 13, at one end of the sub slot 54 and surround the facing part 56 to connect to the main slot 51B. The pair of sub slots 53 and 54 includes the auxiliary sub slot 52 that runs parallel to at least part of the pair of sub slots 53 and 54.

The auxiliary sub slot 52 forms a multiple slot composed of a number of slots that connect to the pair of sub slots 53 and 54 and run in parallel so as to be parallel to at least part of the pair of sub slots 53 and 54. In the case of FIG. 15, two slot portions are arranged in parallel.

Furthermore, in the case of FIG. 15, the pair of sub slots 53 and 54 includes parallel slot portions 53*c* and 54*c* formed to be parallel to the outer edge 13*a*, and the auxiliary sub slot 52 is placed to be parallel to the parallel slot portions 53*c* and 54*c*.

the example of FIG. 15, in which slots are narrow in slot width so as to be inconspicuous, is well designed. Furthermore, a main slot positioned between a pair of facing parts and the parallel slot portions of a pair of sub slots that are parallel to the outer edge 13*a* are formed of a multiple slot having a number of slots that run in parallel, so that it is possible to obtain the same antenna gain as in the case where the slot width is large in these areas. Furthermore, when the slot width is large, an increase in the area of removal of the conductive film may decrease productivity, while reduction in slot width makes it possible to reduce the removal area of the conductive film, thus increasing productivity.

Figure 16:
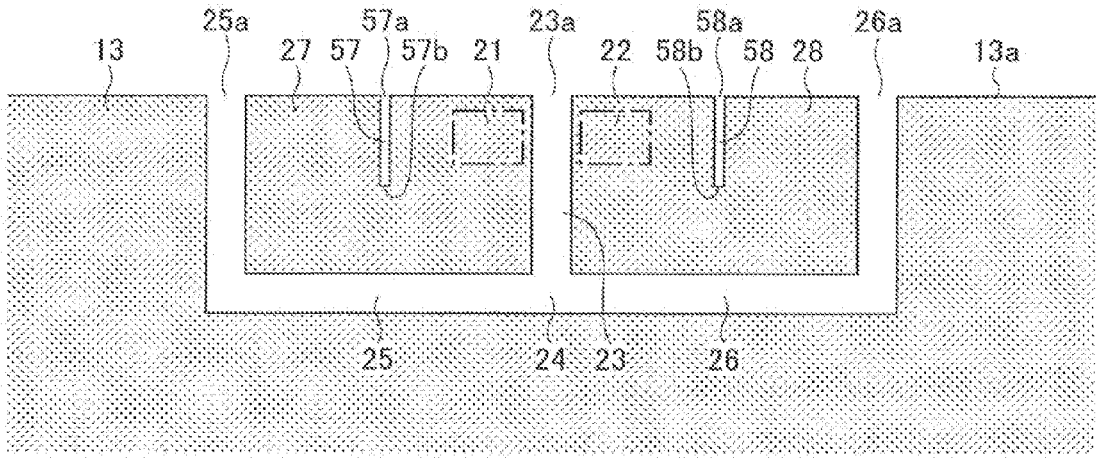
FIG. 16 is a plan view of the conductive film in which slots are formed.

In the case of FIG. 16, the conductive film 13 includes additional slots 57 and 58 formed in a region surrounded by the pair of sub slots 25 and 26. One end of the additional slot 57 is an open end 57*a* that is open at the outer edge 13*a*, and the additional slot 57 is formed in the facing part 27 surrounded by the sub slot 25. The additional slot 57 is an area that has the conductive film 13 linearly removed from the open end 57*a* to an end 57*b* inside the conductive film 13 in such a manner as not to connect to the sub slot 25. One end of the additional slot 58 is an open end 58*a* that is open at the outer edge 13*a*, and the additional slot 58 is formed in the facing part 28 surrounded by the sub slot 26. The additional slot 58 is an area that has the conductive film 13 linearly removed from the open end 58*a* to an end 58*b* inside the conductive film 13 in such a manner as not to connect to the sub slot 26. The additional slots 57 and 58 make it possible to widen the bandwidth of an antenna.

Figure 17:
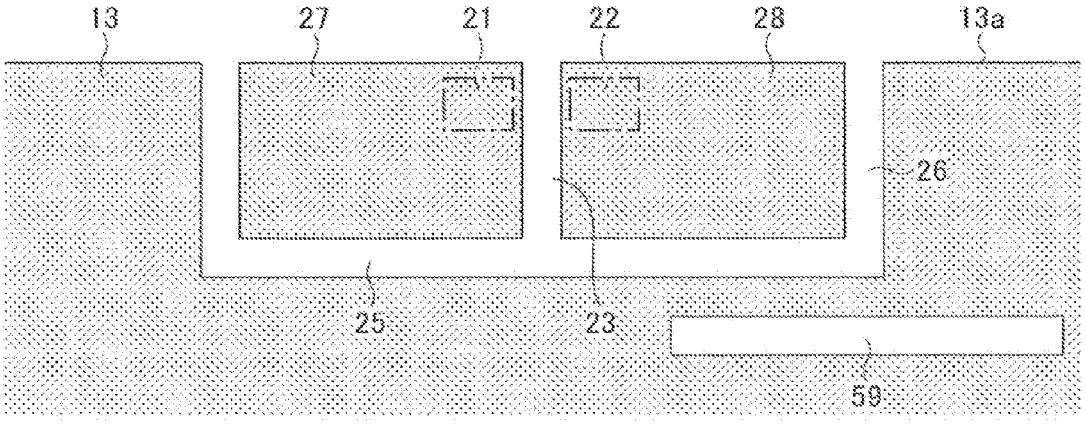
FIG. 17 is a plan view of the conductive film in which slots are formed.

In the case of FIG. 17, the conductive film 13 includes an independent slot 59 formed near the pair of sub slots 25 and 26 outside the pair of facing parts 27 and 28. the independent slot 59 is an area that has the conductive film 13 linearly removed in such a manner as not to connect to either the main slot 23 or the pair of sub slots 25 and 26 or be open at any outer edge of the conductive film 13. The independent slot 59, which is placed parallel to the outer edge 13*a* in the case of FIG. 17, may alternatively be placed near the sub slot 25 in an outer peripheral area of the sub slot 25 or placed near the sub slot 26 in an outer peripheral area of the sub slot 26. The independent slot 59 makes it possible to widen the bandwidth of an antenna and increase the antenna gain.

Figure 20:
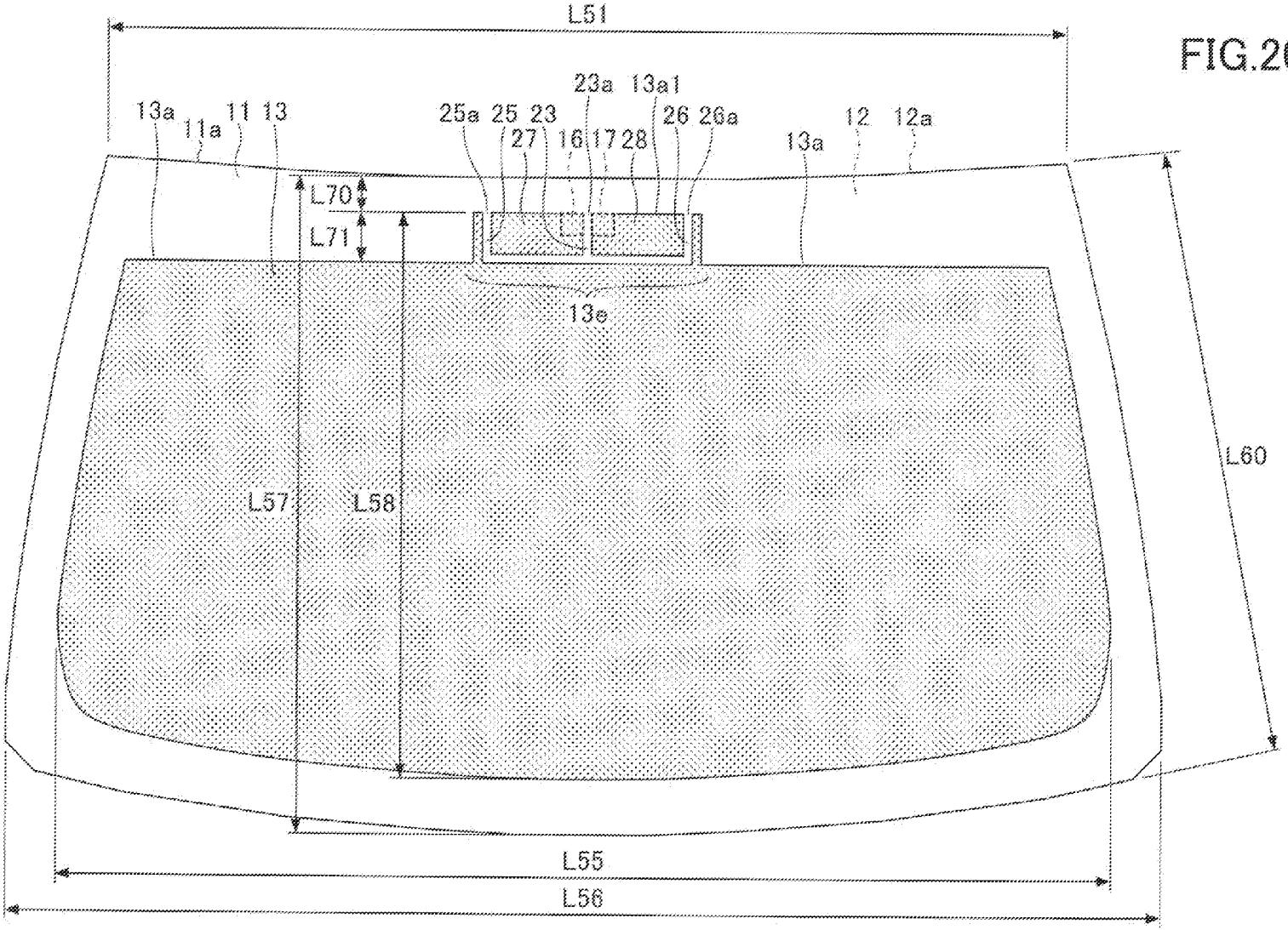
FIG. 20 is a plan view of vehicle window glass provided with the conductive film in which slots are formed.

FIG. 20 illustrates an example where the main slot 23 and the pair of sub slots 25 and 26 of the same configuration as in FIGS. 2 and 3 are formed in a projecting region 13*e* of the conductive film 13.

In FIG. 20, the conductive film 13 includes the projecting region 13*e* that projects toward the peripheral edge 12*a* of the glass plate 12 (or the peripheral edge 11*a* of the glass plate 11), and the main slot 23 and the pair of sub slots 25 and 26 are placed in the projecting region 13*e*. The peripheral edges 11*a* and 12*a* are outer edge portions to be on the roof side of a vehicle when the glass plates 11 and 12 are mounted on the vehicle.

In FIG. 20, the outer edge 13*a* of the conductive film 13 includes a projecting outer edge portion 13*a*1 that is formed to have a shape projecting toward the peripheral edge 12*a* of the glass plate 12 (or the peripheral edge 11*a* of the glass plate 11). The main slot 23 and the pair of sub slots 25 and 26 include open ends that are open at the projecting outer edge portion 13*a*1. The projecting outer edge portion 13*a*1 is an outer edge portion of the projecting region 13*e*.

According to each of the embodiments of the present invention illustrated in FIGS. 3 and 20, compared with the case where the pair of sub slots 25 and 26 is absent, it is possible to reduce the effect of an external environment such as the size of the conductive film 13 on the resonant frequency of an antenna, so that it is possible to easily tune the antenna. In particular, an antenna according to the configuration of FIG. 20 is higher in antenna gain than according to the configuration of FIG. 3.

Figure 21:
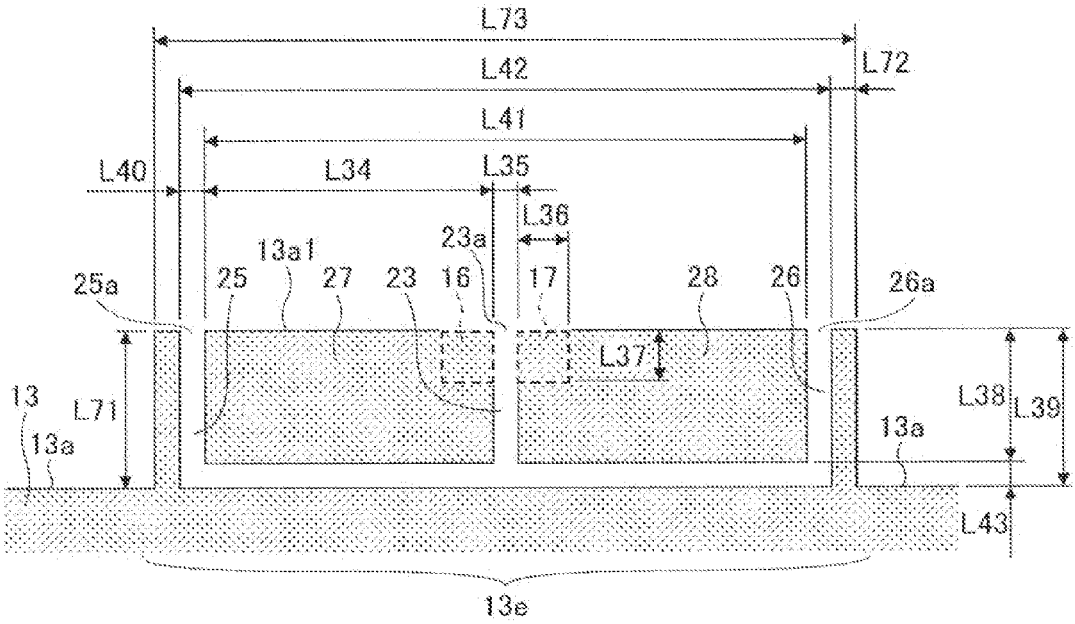
FIG. 21 is a plan view of the conductive film, in which slots are formed.
Figure 23:
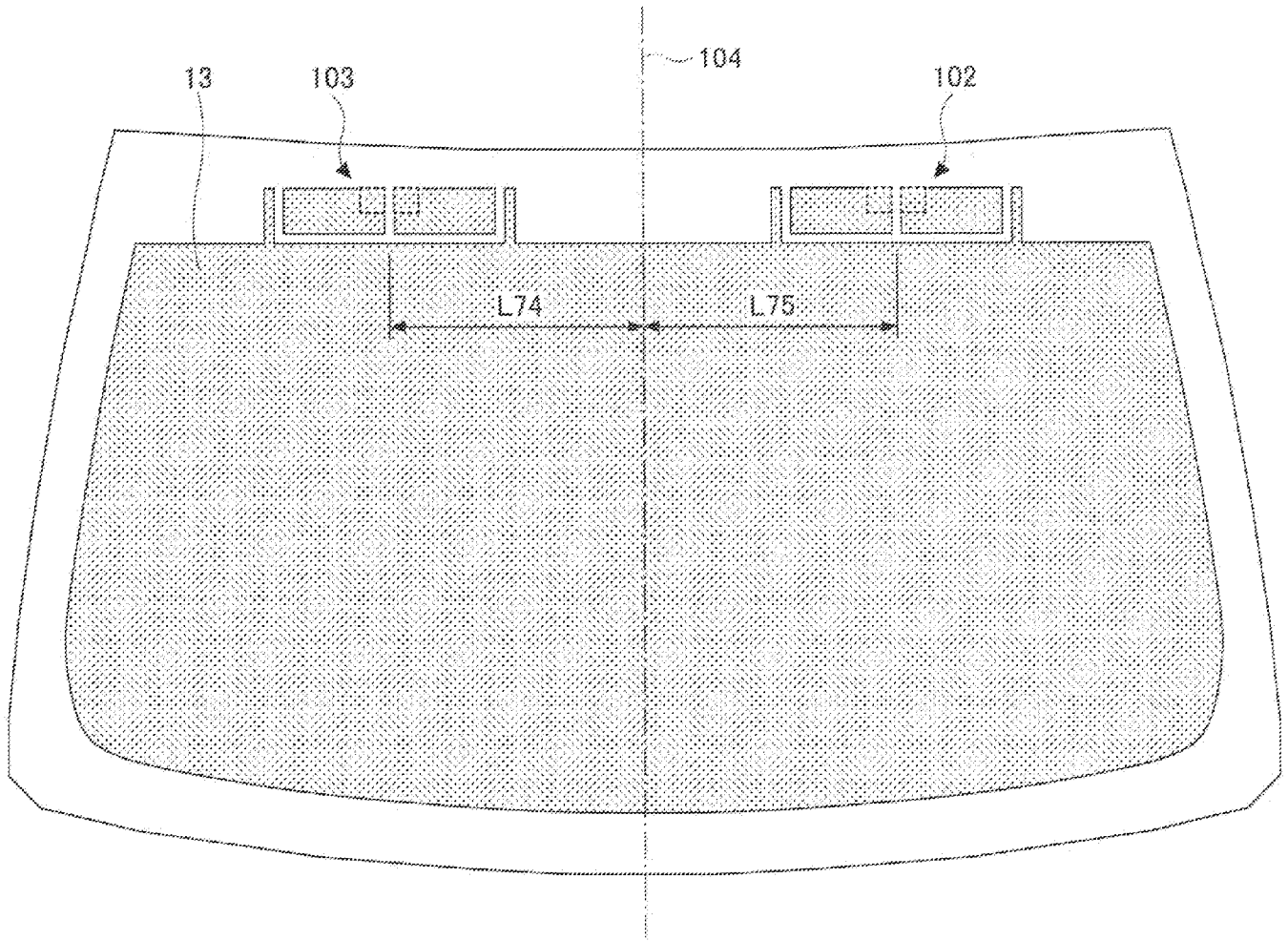
FIG. 23 is a plan view of vehicle window glass provided with the conductive film in which slots are formed.

FIG. 23 illustrates an example where the main slot 23 and the pair of sub slots 25 and 26 of the same configuration as in FIGS. 20 and 21 are formed in each of multiple projecting regions 102 and 103 of the conductive film 13. The projecting regions 102 and 103 have the same configuration as the projection region 13*e* of FIGS. 20 and 21. In FIG. 23, the pair of projecting regions 102 and 103 are symmetrically disposed with respect to a center line 104 of the conductive film 13. An antenna according to FIG. 23 may be used as a diversity antenna that includes an antenna provided in the projecting region 102 on the right side of the center line 104 and an antenna provided in the projecting region 103 on the left side of the center line 104.

According to the embodiment of the present invention illustrated in FIG. 23 as well, compared with the case where the pair of sub slots 25 and 26 is absent, it is possible to reduce the effect of an external environment such as the size of the conductive film 13 on the resonant frequency of an antenna, so that it is possible to easily tune the antenna. In particular, the antenna provided in the projecting region 102 and the antenna provided in the projecting region 103 have substantially the same antenna gain, and there is no substantial change in the antenna gain of both antennas even when the lateral positions of the projecting regions 102 and 103 relative to the center line 104 change. Furthermore, the antenna provided in the projecting region 102 and the antenna provided in the projecting region 103 have substantially laterally symmetrical directivity.

Figure 27:
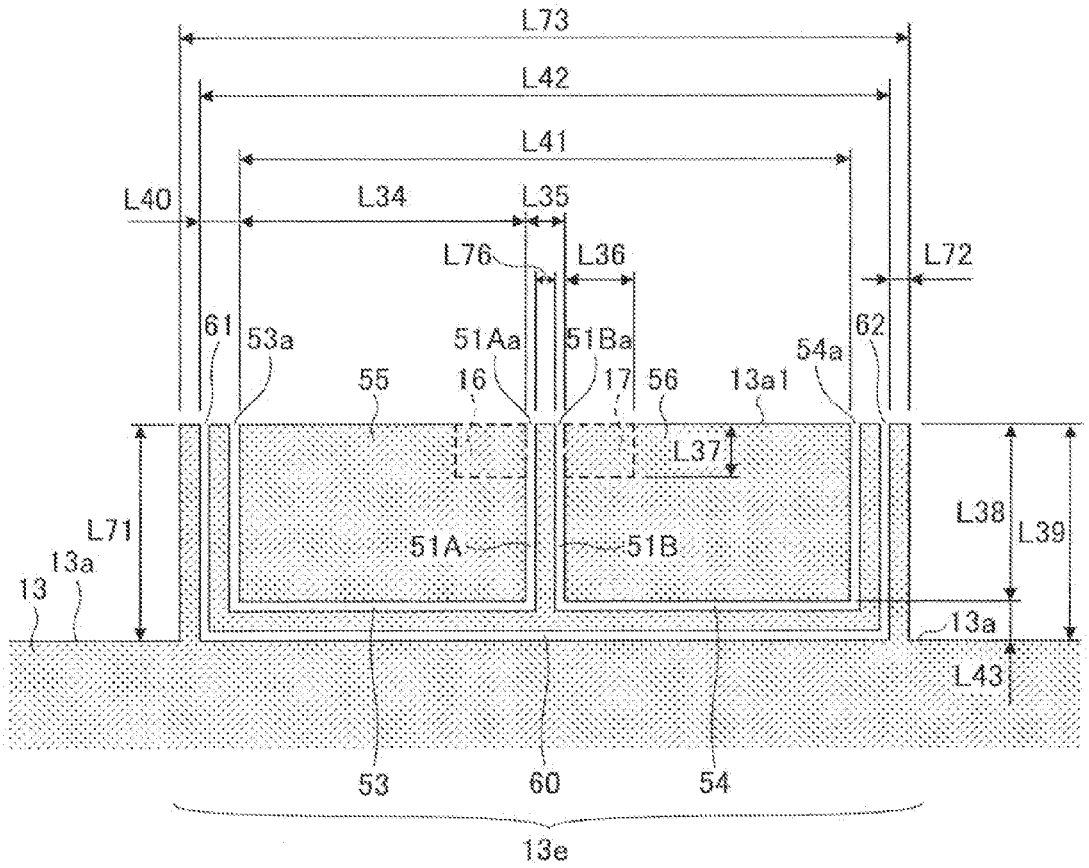
FIG. 27 is a plan view of the conductive film in which slots are formed.

FIG. 27 illustrates a variation of the main slot 23 and the pair of sub slots 25 and 26 illustrated in FIG. 21. FIG. 27 is a diagram that assumes a configuration where, for example, laser processing is performed to rim each slot of FIG. 21. It may be created by masking.

In FIG. 27, the conductive film 13 includes the pair of facing parts 55 and 56, the pair of main slots 51A and 51B, the pair of sub slots 53 and 54, and an auxiliary sub slot 60. These slots are formed to be narrower in slot width than in the example of FIG. 21. The pair of facing parts 55 and 56, the pair of main slots 51A and 51B, and the pair of sub slots 53 and 54 have the same configuration as in FIG. 15.

The pair of sub slots 53 and 54 includes the auxiliary sub slot 60 that runs parallel to at least part of the pair of sub slots 53 and 54. The auxiliary sub slot 60 forms a multiple slot composed of a number of slots that run in parallel so as to be parallel to at least part of the pair of sub slots 53 and 54 without connecting to the pair of sub slots 53 and 54. In the case of FIG. 27, two slot portions are arranged in parallel. One end of the auxiliary sub slot 60 is an open end 61 that is open at the projecting outer edge portion 13*a*1, and the other end of the auxiliary sub slot 60 is an open end 62 that is open at the projecting outer edge portion 13*a*1.

According to the embodiment of the present invention illustrated in FIG. 27 as well, it is possible to reduce the effect of an external environment such as the size of the conductive film 13 on the resonant frequency of an antenna, so that it is possible to easily tune the antenna. In particular, the antenna according to the configuration of FIG. 27 and the antenna according to the configuration of FIG. 21 have substantially the same antenna gain. Accordingly, for example, by tuning an antenna in a configuration like FIG. 21 and thereafter finally designing an antenna of a configuration like FIG. 27, it is made easy to advance trial production and a study, and design is improved.

Figure 28:
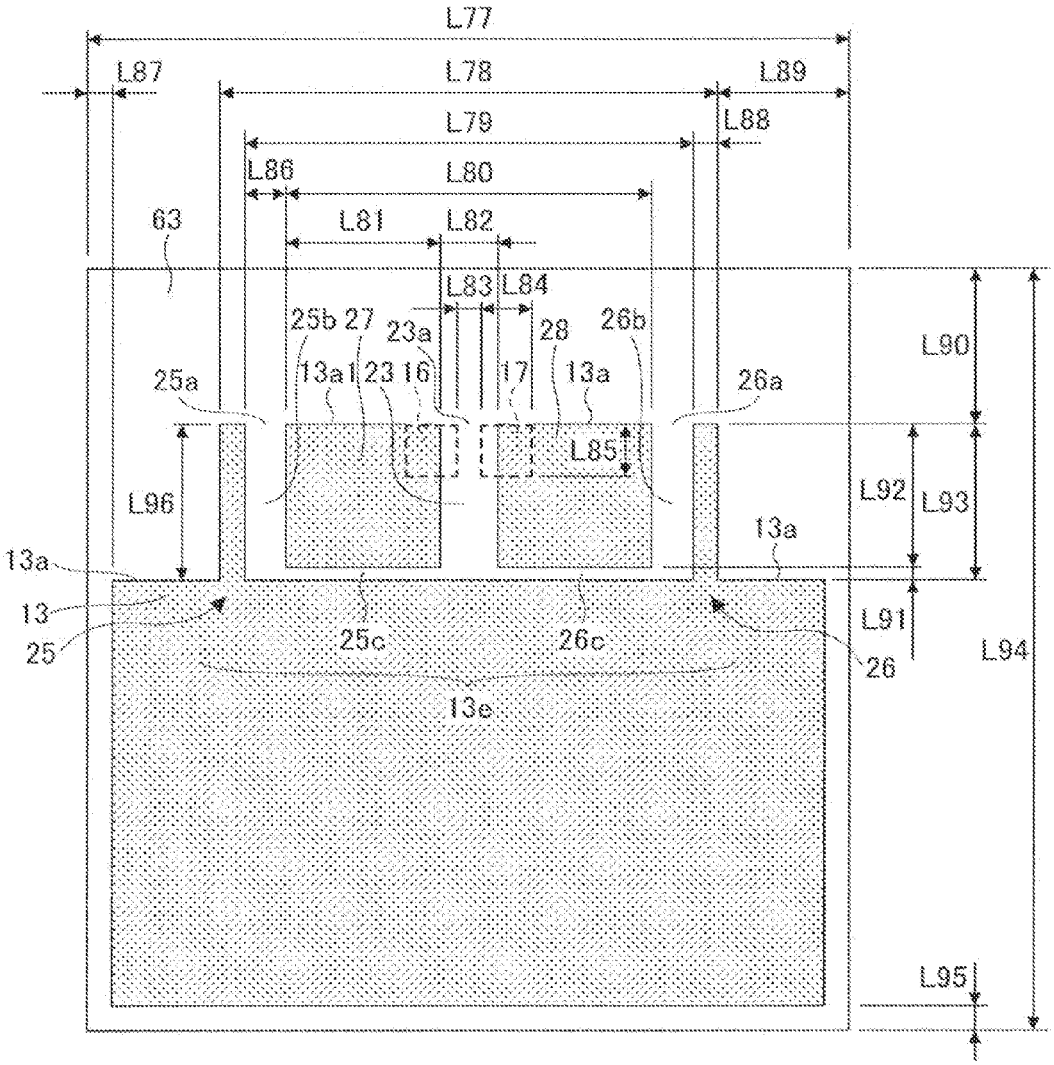
FIG. 28 is a plan view of a glass plate provided with the conductive film in which slots are formed.

FIG. 28 illustrates a variation of the main slot 23 and the pair of sub slots 25 and 26 illustrated in FIGS. are different from each other in slot width. FIG. 28 illustrates a configuration where a slot width L82 of the main slot 23 is greater than a slot width L86 of the slot portions 25*b* and 26*b*, and the slot width L86 of the slot portions 25*b* and 26*b* is greater than a slot width L91 of the parallel slot portions 25*c* and 26*c*. By tuning the slot width of each slot, it is possible to increase antenna gain compared with the case where all slots are equal in slot width.

Vehicle window glass and antennas according to the embodiments are described above. However, the present invention is not limited to the above described embodiments. Combinations of some or all of the embodiments and variation of the embodiments may be made without departing from the scope of the present invention.

For example, the shape of facing parts that face electrodes across a dielectric may be a polygonal shape other than a triangular shape or a quadrangular shape and may be a round shape such as a circle, a substantial circle, an ellipse, or a substantial ellipse.

EXAMPLE 1

The results of comparative measurement of the reflection coefficients S11 of examples where the antenna of Patent Document 1 noted above illustrated in FIG. 18 was formed in a square conductive film 113 and a conductive film of a size corresponding to the shape of automobile window glass and these conductive films were provided on actual vehicle window glass (comparative examples) and examples where an antenna according to an embodiment of the present invention was formed in the square conductive film 13 and the conductive film 13 of a size corresponding to the shape of automobile window glass as illustrated in FIGS. 2 and 3, respectively, and these conductive films are provided on actual vehicle window glass (examples) are shown.

The reflection coefficient S11 was actually measured with automobile window glass provided with a conductive film where an antenna was formed being attached to the window frame of an automobile in an anechoic chamber with an antenna portion being inclined approximately 25° to a horizontal plane. A connector was attached to the electrodes 16 and 17 so that the inner conductor of a coaxial cable was connected to the electrode 17 and the outer conductor of the coaxial cable was connected to the electrode 16, and the electrodes 16 and 17 were connected to a network analyzer via the coaxial cable. The reflection coefficient S11 was measured at intervals of approximately 1.5 MHz in the frequency range of the digital terrestrial television broadcasting band of 470 to 710 MHz.

For experimental convenience, the configuration of a stack at the time of measurement of the reflection coefficient S11 is a configuration where the resin film 15 on which the conductive film 13 or 113 is formed is formed on an exterior surface of the first glass plate 11 in the direction of the arrow BB in the configuration illustrated in FIG. 1 in each of the comparative examples and the examples.

Figure 18:
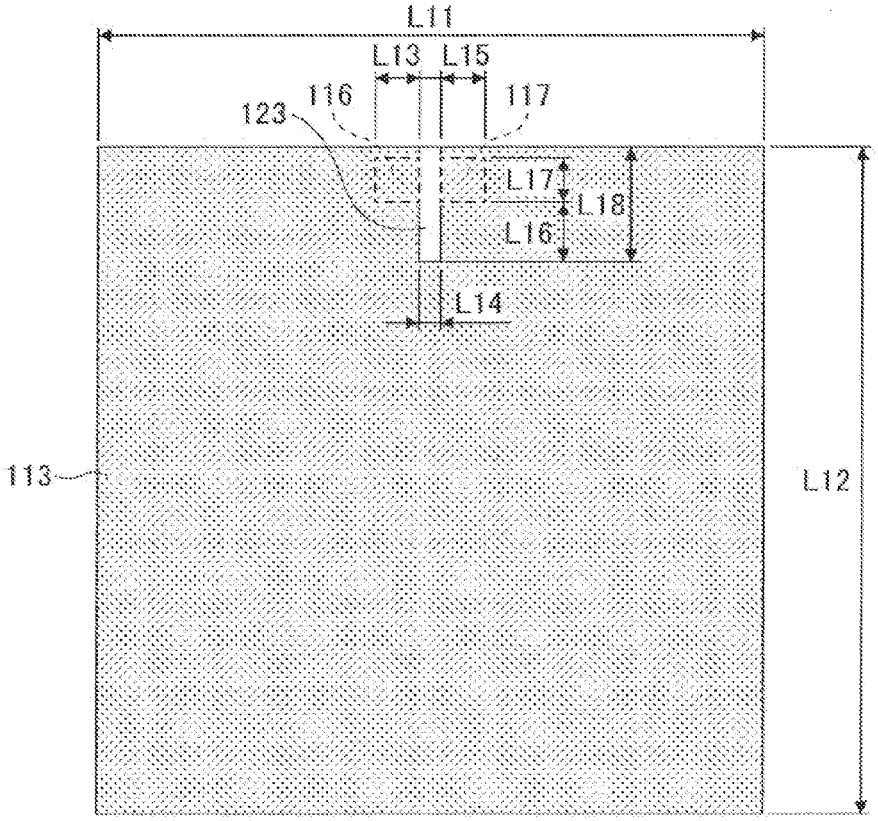
FIG. 18 is a plan view of the conductive film in which a slot is formed (comparative example)

FIG. 18 illustrates a plan view of the antenna of Patent Document 1 where a slot 123 is formed in the square conductive film 113 that does not correspond to the shape of actual automobile window glass. The slot 123 is placed between a pair of electrodes 116 and 117 in a plan view. The example in which the antenna of FIG. 18 was provided on actual automobile window glass was implemented with the same glass plate as the below-described automobile window glass of FIG. 3, and the antenna was provided so as to have the slot 123 of FIG. 18 coincide with the main slot 23 of FIG. 3. Furthermore, the antenna was likewise provided so as to have the slot 123 of FIG. 18 coincide with the main slot 23 of FIG. 3 in the example where the antenna of FIG. 18 was formed, on a conductive film of a sire corresponding to the shape of automobile window glass as well.

FIG. 2 illustrates a plan view of an antenna according to an embodiment of the present invention where the main slot 23 and the sub slots 25 and 26 are formed in the square conductive film 13 that does not correspond to the shape of actual automobile window glass. FIG. 3 illustrates a plan view of an antenna according to an embodiment of the present invention where the main slot 23 and the sub slots 25 and 26 are formed in the conductive film 13 stacked on actual automobile window glass. The example in which the antenna of FIG. 2 was provided on actual automobile window glass was implemented with the same glass plate as the automobile window glass of FIG. 3, and the antenna was provided so as to have the main slot 23 of FIG. 2 coincide with, the main slot 23 of FIG. 3.

In FIG. 18, the dimensions of parts at the time of measurement of the reflection coefficient S11 were, in units of millimeters, as follows:

L11: 300
L12: 300
L13: 20
L14: 10
L15: 25
L16: 27
L17: 20
L18: 52.

In FIGS. 2 and 3, the dimensions of parts at the time, of measurement of the reflection coefficient S11 were, in units of millimeters, as follows.

L31: 300
L32: 300
L33: 22.5
L34: 112.5
L35: 10
L36: 20
L37: 20
L38: 51.25
L39: 61.23
L40: 10
L41: 235
L42: 255
L51: 1166
L52: 1104
L55: 1285
L56: 1402
L57: 802
L58: 693
L59: 650
L60: 757.

The sheet resistance of the conductive film 13 was 1.0 [Ω].

Figure 19:
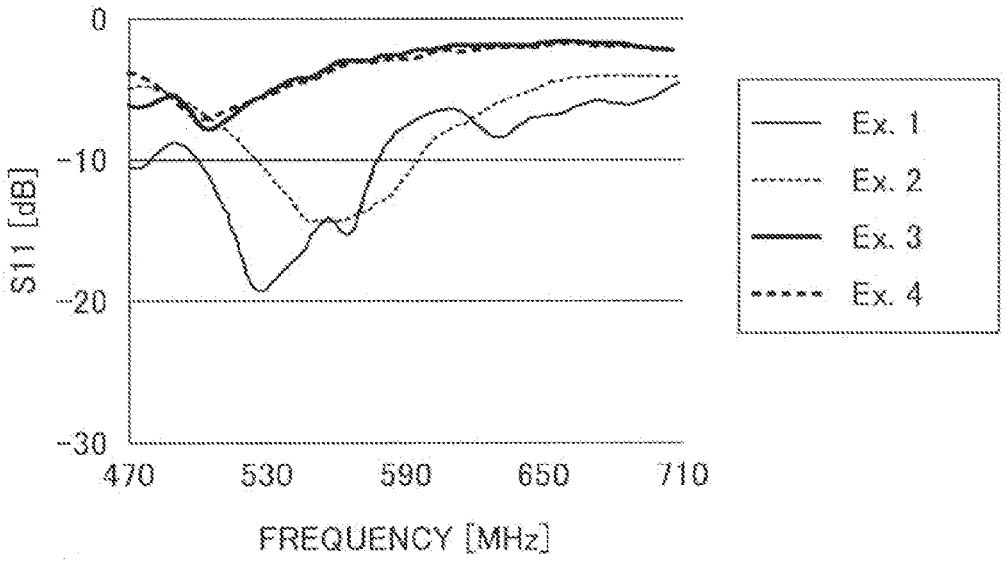
FIG. 19 shows the results of measurement of a reflection coefficient.

FIG. 19 shows the results of actual measurement of S11, where "Ex. 1" indicates the case where the antenna of FIG. 18 was applied to a conductive film of a size corresponding to the shape of automobile window glass, "Ex. 2" indicates the case of FIG. 18 of a square conductive film, "Ex. 3" indicates the case of FIG. 3 of a conductive film of a size corresponding to the shape of automobile window glass, and "Ex. 4" indicates the case of FIG. 2 of a square conductive film.

As shown in FIG. 19, when "Ex. 1" and "Ex. 2" are compared, there are large differences in the reflection coefficient S11 and the resonant frequency. In contrast, when "Ex. 3" and "Ex. 4" are compared, there are no substantial differences in the reflection coefficient S11 and the resonant frequency. Thus, according to an embodiment of the present invention where the difference in the measurement result of the reflection coefficient S11 between the case where an antenna was formed on a conductive film corresponding to the shape of actual automobile window glass and the case where an antenna was formed on a square conductive film is limited, antenna characteristics are unlikely to vary even when an antenna tuned in a virtual development environment is mounted on an actual vehicle. Therefore, it is easy to predict antenna characteristics at the development stage, thus making it easy to advance the development of antennas.

Furthermore, because it is possible to experiment most of the development with small glass plates, workability is increased.

Furthermore, according to an embodiment of the present invention, in tuning by a simulation as well, it is possible to set the dimensions of a conductive film and a glass plate to values smaller than actual values, so that it is possible to reduce computational resources (CPU speed and the amount of memory). As a result, computation time is reduced, so that workability is increased.

EXAMPLE 2

Measurement results of antenna gain of the antenna according to the configuration of FIG. 3 and the antenna, according to the configuration of FIG. 20 are shown below as EXAMPLE 2.

In the measurement of each of the configurations of FIGS. 3 and 20, for experimental convenience, copper foil was substituted for the conductive film 13 and automobile window glass was simulated. Further/more, for experimental convenience, the configuration of a stack at the time of measurement of antenna gain was a configuration where the copper foil was formed on a surface of the glass plate 11 on the vehicle exterior side in the direction indicated by the arrow BB (see FIG. 1) (that is, a configuration where the copper foil substituting the conductive film 13 is positioned on the opposite side of the glass plate 11 from the illustrated position in FIG. 7). Furthermore, in order to maintain the manufacturing accuracy of the antenna, the projecting region 13*e* was formed on a flexible substrate. That is, the antenna according to the configuration of FIG. 20 was made by substituting copper foil for the facing parts 27 and 28 on the flexible substrate, forming the main slot 23 and the pair of sub slots 25 and 26, and connecting the flexible substrate and the conductive film 13 made of cooper foil. Furthermore, the electrodes 16 and 17 are formed with copper foil on a surface of the flexible substrate opposite to its surface on which the copper foil of the facing parts 27 and 28 was formed.

The antenna gain was actually measured by attaching automobile window glass provided with copper foil on which an antenna was formed to the window frame of the windshield of an automobile in on anechoic chamber with an antenna portion being inclined approximately 25° to a horizontal place. A connector connected to one end of a coaxial cable was attached to the electrodes 16 and 17 so that the inner conductor of the coaxial cable was connected to the electrode 17 and the outer conductor of the coaxial cable was connected to the electrode 16. The outer conductor of the coaxial cable was screwed to the body of the automobile at a point 180 mm from the connector. The antenna gain was measured at intervals of approximately 6 MHz with respect to the frequencies of 473 to 713 MHz within the frequency range of the digital terrestrial television broadcasting band.

In FIGS. 3 and 20, automobile window glass of the same configuration was used at the time of measurement of antenna gain, and the dimensions of parts at the time of measurement of antenna gain were, in units of millimeters, as follows:

L51: 1166
L52: 1104
L55: 1285
L56: 1402
L57: 802
L58: 693
L59: 650
L60: 757
L70: 40.

L70 is the shortest, distance between the open end 23*a* and the peripheral edge 12*a*. Letting L70 be 40 mm, the shortest distance between the open end 23*a* and an end of the flange of a vehicle body with the automobile window glass being mounted on the vehicle is approximately 20 mm.

Furthermore, in FIGS. 3 and 20, the main slot 23, the pair of sub slots 25 and 26, and the electrodes 16 and 17 have the same configurations. FIG. 21 is an enlarged view of part of FIG. 20, illustrating a plan view of the projecting region 13*e*. The dimensions of parts at the time of measurement of antenna gain were, in units of millimeters, as follows:

L34: 75.75
L35: 10
L36: 24
L37: 24
L38: 50
L39: 60
L40: 10
L41: 161.5
L42: 181.5
L43: 10
L71: 60
L72: 10
L73: 201.5.

L71 is the length of the projection of the projecting outer edge portion 13*a*1 from other portions of the outer edge 13*a*.

The automobile window glass is laminated glass formed by bonding together two glass plates each having a plate thickness of 2 mm via an intermediate film having a film thickness of 0.381 mm.

Figure 22:
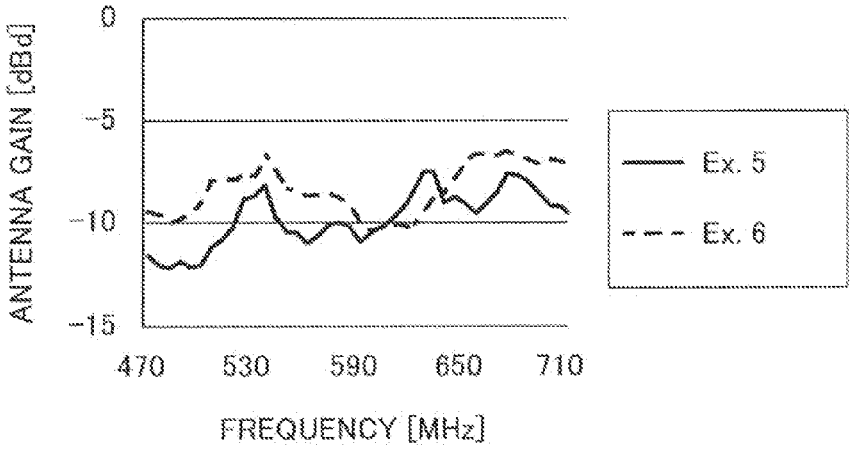
FIG. 22 shows the results of measurement of antenna gain.

The FIG. 22 shows the results of measurement of antenna gain, where "Ex. 5" indicates the antenna gain of the antenna according to the configuration of FIG. 3 and the average power of the antenna gain measured at intervals of 6 MHz in 473 to 713 MHz was −9.5 dBd, while "Ex. 6" indicates the antenna gain of the antenna according to the configuration of FIG. 20 and the average power of the antenna gain measured at intervals of 6 MHz in 473 to 713 MHz was −8.2 dBd. Accordingly, the antenna, according to the configuration of FIG. 20 has a higher antenna gain than the antenna according to the configuration of FIG. 3.

EXAMPLE 3

Figure 24:
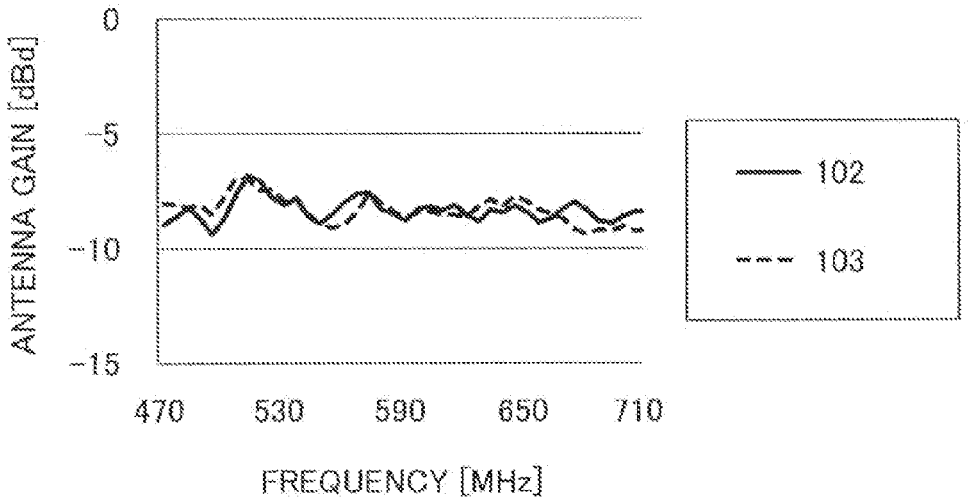
FIG. 24 shows the results of measurement of antenna gain.
Figure 25:
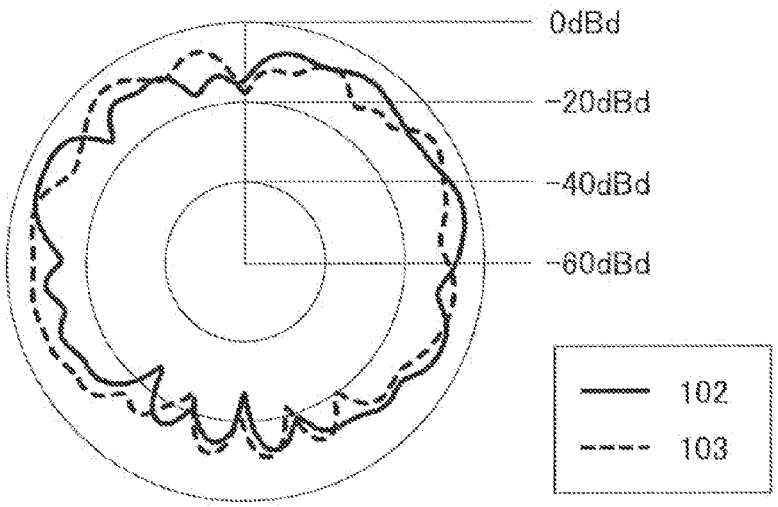
FIG. 25 shows the results of measurement of directivity.
Figure 26:
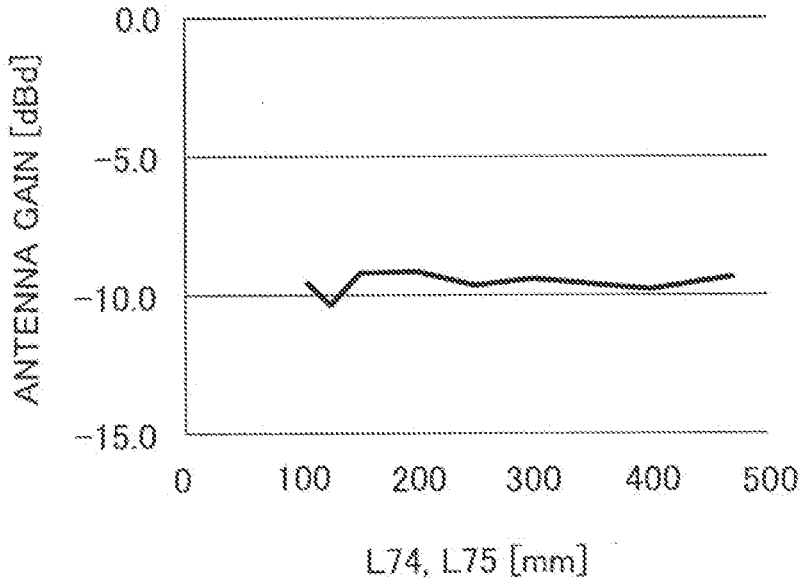
FIG. 26 shows the results of measurement of antenna gain.

Measurement results of antenna gain and directivity of the antenna provided in the projecting region 102 and the antenna provided in the projecting region 103 of the antenna according to the configuration of FIG. 23 are shown below as EXAMPLE 3 (FIGS. 24, 25 and 26).

In the measurement of the configuration of FIG. 23, for experimental convenience; the conductive film 13 and the projecting regions 102 and 103 were formed in the same manner as in EXAMPLE 2. Furthermore, with respect to the configuration of FIG. 23, the configuration of a stack at the time of the measurement of FIGS. 24 and 25 is the configuration of FIG. 6 (that is, a configuration where the conductive film 13 is replaced with copper foil in FIG. 6) , and the configuration of a stack at the time of the measurement of FIG. 26 is the same as in EXAMPLE 2 described above.

In FIG. 23, the dimensions at the time of the measurement of FIGS. 24 and 25 were, in units of millimeters, as follows:

L74: 300
L75: 300.

L74 and L75 are each the shortest distance between the main slot 23 and the center line 104. Other measurement conditions are the same as in EXAMPLE 2 described above.

FIG. 24 shows the results of measurement of antenna gain, where "102" indicates the antenna gain of the antenna provided in the projecting region 102 and the average power of the antenna gain measured at intervals of 6 MHz in 473 to 713 MHz was −8.6 dBd, while "103" indicates the antenna gain of the antenna provided in the projecting region 103 and the average power of the antenna gain measured at intervals of 6 MHz in 473 to 713 MHz was −8.2 dBd. Accordingly, the antenna provided in the projecting region 102 and the antenna provided in the projecting region 103 have substantially the same antenna gain.

FIG. 25 shows the results of measurement of directivity. In FIG. 25, the upper side indicates the vehicle front side, and the lower side indicates the vehicle rear side. Furthermore, "102" indicates the directivity of the antenna provided in the projecting region 102 at 593 MHz, and "103" indicates the directivity of the antenna provided in the projecting region 103 at 593 MHz. Accordingly, the antenna provided in the projecting region 102 and the antenna provided in the projecting region 103 have substantially the same directivity that is laterally axisymmetric.

FIG. 26 shows the results of measurement of antenna gain in the case where L74 and L75 were varied. The antenna gain on the vertical axis indicates the average of the antenna gain of the antenna provided in the projecting region 102 and the antenna gain of the antenna provided in the projecting region 103. L74 and L75 on the horizontal axis were equally varied from 100 mm to 460 mm. As shown in FIG. 26, even when the lengths of L74 and L75 vary, variations in the antenna gain are limited. Therefore, design freedom is high with respect to positions where the projecting regions 102 and 102 are placeable.

EXAMPLE 4

Measurement results of antenna gain of an antenna where the slots according to the configuration, of FIG. 27 are provided in each of the projecting regions 102 and 103 (see FIG. 23) and an antenna where the slots according to the configuration of FIG. 21 are provided in each of the projecting regions 102 and 103 are shown below as EXAMPLE 4.

In each of the measurements of the configurations of FIGS. 27 and 21, in FIGS. 23 and 27, the dimensions at the time of measurement of antenna gain were, in units of millimeters, as follows:

L74: 300
L75: 300
L76: 9.7.

Furthermore, in FIG. 27, all of the pair of main slots 51A and 51B, the pair of sub slots 53 and 54, and the auxiliary sub slot 60 have a slot width of 0.15 mm. Other measurement conditions are the same as in EXAMPLE 2 described above.

The average power of the antenna gain of the antenna according to the configuration of FIG. 21 provided in the projecting region 102 and the antenna gain of the antenna according to the configuration of FIG. 21 provided in the projecting region 103 was −9.5 dBd. The average power of the antenna gain of the antenna according to the configuration of FIG. 27 provided in the projecting region 102 and the antenna gain of the antenna according to the configuration of FIG. 27 provided in the projecting region 103 was −9.4 dBd. Accordingly, the antenna according to the configuration of FIG. 27 and the antenna according to the configuration of FIG. 21 have substantially the same antenna gain. Therefore, the antenna according to the configuration of FIG. 27 is a well-designed antenna with a reduced slot opening area.

EXAMPLE 5

Measurement results of antenna gain of the antenna according to the configuration of FIG. 21 and the antenna according to the configuration of FIG. 28 are shown below as EXAMPLE 5.

In each of the measurements of the configurations of FIGS. 21 and 28, the configuration of a stack at the time of measurement of antenna gain and the substitution by copper foil are the same as in EXAMPLE 2 described below, while the size of the glass plate and the installation condition of the glass plate are different.

As laminated glass formed by bonding together the two glass plates 11 and 12 each having a plate thickness of 2 mm via an intermediate film having a film thickness of 0.381 mm, a square glass plate 63 (L77×L94: 300 mm×300 mm) illustrated in FIG. 28 was used.

The glass plate 63 was provided on a metal frame (500 mm×500 mm) substituted for a vehicle body at substantially the same inclination (25°) as the windshield of a vehicle so as to cover an opening (300 mm×300 mm) provided inside the metal frame.

In FIG. 21, the dimensions of parts at the time of measurement of antenna gain are the same as in EXAMPLE 2 described above. In FIG. 28, the dimensions of parts at the time of measurement of antenna gain were, in units of millimeters, as follows:

L78: 201.5
L79: 181.5
L80: 151.5
L81: 63.25
L83: 10
L84: 24
L85: 24
L86: 15
L87: 10
L88: 10
L89: 49.25
L90: 60
L91: 5
L92: 55
L93: 30
L94: 300
L95: 10
L96: 60.

L96 is the length of the projection of the projecting outer edge portion 13*a*1 from other portions of the outer edge 13*a*.

Figure 29:
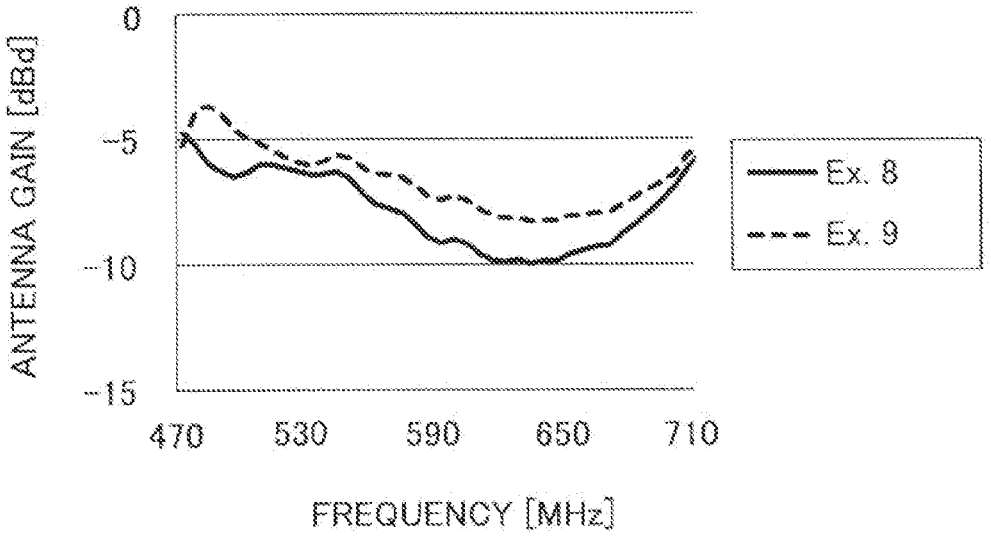
FIG. 29 shows the results of measurement of antenna gain.

FIG. 29 shows the results of measurement of antenna gain, where "Ex. 8" indicates the antenna gain of the antenna according to the configuration of FIG. 21 and the average power of the antenna gain measured at intervals of 6 MHz in 473 to 713 MHz was −7.5 dBd, while "Ex. 9" indicates the antenna gain of the antenna according to the configuration of FIG. 28 and the average power of the antenna gain measured at intervals of 6 MHz in 473 to 713 MHz was −6.3 dBd. Accordingly, the antenna according to the configuration of FIG. 28 where the slots are tuned in slot width has a higher antenna gain than the antenna according to the configuration of FIG. 21 where all of the slots are equal in slot width.

The present invention is suitably applicable for use as an antenna for automobile, designed to receive the digital terrestrial television broadcasting, the analog television broadcasting in UHF band, the digital television broadcasting in the United States of America, the digital television broadcasting in the European Union regions, or the digital television broadcasting in the People's Republic of China. Other applications include the FM broadcasting band (76 MHz to 90 MHz) in Japan, FM broadcasting band (88 MHz to 108 MHz) in the United States of America, the television VHF band (90 MHz to 108 MHz, 170 MHz to 222 MHz), and a keyless entry system for automobile (300 MHz to 450 MHz).

Additional applications include the 800 MHz band (810 MHz to 960 MHz) for car phone, the 1.5 GHz band (1.429 GHz to 1.501 GHz) for car phone, the GPS (Global Positioning System), the GPS signals of satellite (1575.42 MHz), and the VICS (registered trademark) (Vehicle Information and Communication System: 2.5 GHz).

Further applications include the ETC (Electronic Toll Collection System) communication (non-stop automatic toll collection system, transmission frequency of roadside radio device: 5.795 GHz or 5.805 GHz, reception frequency of roadside radio device: 5.835 GHz or 5.845 GHz), the DSRC (Dedicated Short Range Communication, 915 MHz band, 5.8 GHz band, 60 GHz band, and the microwave (1 GHz to 30 GHz), the millimeter wave (30 GHz to 300 GHz), and the SDARS (Satellite Digital Audio Radio Service, 2.34 GHz, 2.6 GHz) communications.

What is claimed is:

1. Vehicle window glass, comprising:

a glass plate;

a dielectric;

a conductive film placed between the glass plate and the dielectric; and an antenna including a pair of electrodes placed to face the conductive film across the dielectric, wherein the conductive film includes a pair of facing parts that, faces the pair of electrodes across the dielectric;

a main slot; and a pair of sub slots, wherein the main slot has, at one end, an open end that is open at an outer edge of the conductive film, and is formed between the pair of facing parts, wherein each of the pair of sub slots has, at one end, an open end that is open at the outer edge of the conductive film, and wherein one of the sub slots connects, at the other end, to the main slot so as to surround sue of the pair of facing parts, and the other of the sub slots connects, at the other end, to the main slot so as to surround the other of the pair of facing parts.

2. The vehicle window glass as claimed in claim 1, wherein, the main slots is formed of multiple slots.

3. The vehicle window glass as claimed in claim 2, wherein the multiple slots are formed to run in parallel.

4. The vehicle window glass as claimed in claim 1, wherein the pair of sub slots includes a parallel slot portion formed to be parallel to the outer edge of the conductive film, and a width of the parallel slot portion is greater than a width of another portion of the sub slots.

5. The vehicle window glass as claimed in claim 1, wherein the pair of sub slots includes an auxiliary sub slot that runs parallel to at least a part of the pair of sub slots.

6. The vehicle window glass as claimed in claim 1, wherein the conductive film includes an additional slot in the pair of facing parts.

7. The vehicle window glass as claimed in claim 6, wherein the additional slot connects to the main slot and the sub slots.

8. The vehicle window glass as claimed in claim 6, wherein one end of the additional slot is an open end that is open at the outer edge of the conductive film.

9. The vehicle window glass as claimed in claim 8, wherein the other end or the additional slot connects to the sub slots.

10. The vehicle window glass as claimed in claim 1, wherein the conductive film includes an independent slot formed near the pair of sub slots outside the pair of facing parts.

11. The vehicle window glass en claimed in claim 1, wherein the open end of the main slot and the open end of the pair or sub slots are formed on a same side of the outer edge of the conductive film.

12. The vehicle window glass as claimed in claim 1, wherein the glass plate is a first glass plate, the dielectric is a second glass plate, and the vehicle window glass is formed as laminated glass by bonding the first glass plate and the second glass plate via an intermediate film.

13. The vehicle window glass as claimed in claim 12, wherein the conductive film is formed on a surface of one of the first glass plate and the second glass plate.

14. The vehicle window glass as claimed in claim 12, wherein the conductive film is formed on a resin film and is held between the first glass plate and the second glass plate.

15. The vehicle window glass as claimed in claim 1, wherein the conductive film includes a projecting region that, projects toward a peripheral edge of the dielectric, and the main sot and the pair of sub slots are provided in the projecting region.

16. The vehicle window glass as claimed in claim 1, wherein the outer edge of the conductive film includes a projecting outer edge portion formed in a shape projecting toward the peripheral edge of the dielectric, and the main slot and the pair of sub slots are open at the projecting outer edge portion.

17. An antenna, comprising:

a dielectric;

a conductive film; and a pair of electrodes placed to face the conductive film across the dielectric, wherein the conductive film includes a pair of facing parts that faces the pair of electrodes across the dielectric;

a main slot; and a pair of sub slots, wherein the main slot has, at one end, an open end that is open, at an outer edge of the conductive film, and is formed between the pair of facing parts, wherein each of the pair of sub slots has, at one end, an open end that is open at the outer edge of the conductive film, and wherein one of the sub slots connects, at the other end, to the main slot so as to surround one of the pair of facing parts, and the other of the sub slots connects, at the other end, to the main slot so as to surround the other of the pair of facing parts.

* * * * *